US011021865B2

(12) United States Patent
Houghton et al.

(10) Patent No.: US 11,021,865 B2
(45) Date of Patent: Jun. 1, 2021

(54) GUSSET PLATE CONNECTION OF BRACED BEAM TO COLUMN

(71) Applicant: MITEK HOLDINGS, INC., Wilmington, DE (US)

(72) Inventors: David L. Houghton, Mission Viejo, CA (US); Behzad Rafezy, Beverly Hills, CA (US); Jared J. Adams, Mission Viejo, CA (US)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 16/215,426

(22) Filed: Dec. 10, 2018

(65) Prior Publication Data

US 2019/0106875 A1 Apr. 11, 2019

Related U.S. Application Data

(63) Continuation of application No. 14/729,995, filed on Jun. 3, 2015, now abandoned.

(51) Int. Cl.
*E04B 1/24* (2006.01)

(52) U.S. Cl.
CPC .... *E04B 1/2403* (2013.01); *E04B 2001/2415* (2013.01); *E04B 2001/2418* (2013.01);
(Continued)

(58) Field of Classification Search
CPC ..... E04B 2001/2415; E04B 2001/2418; E04B 2001/2439; E04B 2001/2448;
(Continued)

(56) References Cited

U.S. PATENT DOCUMENTS 1,211,446 A * 1/1917 Horn ..... E04B 1/2403 403/173
1,883,376 A * 10/1932 Hilpert ..... E04B 1/24 52/654.1

(Continued)

FOREIGN PATENT DOCUMENTS

JP 09209477 A 8/1997
JP 2003074126 3/2003

(Continued)

OTHER PUBLICATIONS

American Institute of Steel Construction, Prequalified Connections for Special and Intermediate Steel Moment Frames for Seismic Applications, ANSI/AISC 358-10, ANSI/AISC 358s1-11, Including Supplement No. 1, 2011, 178 pages, Chicago, Illinois.

(Continued)

*Primary Examiner* — Kyle J. Walraed-Sullivan
(74) *Attorney, Agent, or Firm* — Stinson LLP

(57) ABSTRACT

A joint connection structure of a building framework includes a column assembly including a column and a pair of gusset plates connected to the column on opposite sides of the column and extending laterally outward from the column. A full-length beam assembly includes a full-length beam having upper and lower flanges and an end portion received between the gusset plates. The full-length beam is bolted to the gusset plates of the column assembly to connect the full-length beam assembly to the column assembly. A brace has an end portion received between the gusset plates and makes an angle with the beam and with the column. The brace is bolted to the gusset plates at the end portion of the brace.

20 Claims, 23 Drawing Sheets

(52) U.S. Cl.
CPC ..... *E04B 2001/2448* (2013.01); *E04B 2001/2451* (2013.01); *E04B 2103/06* (2013.01)

(58) Field of Classification Search
CPC ..... E04B 2001/2496; E04B 2001/2451; E04B 2001/2408; E04H 9/028
USPC ..... 52/652.1, 656.9, 167.1, 167.3, 167.4, 52/655.1, 657, 648, 638
See application file for complete search history.

(56) References Cited

U.S. PATENT DOCUMENTS 2,514,607 A * 7/1950 McLean ..... E01D 6/00 52/692
2,720,291 A 10/1955 Larkin
2,840,014 A * 6/1958 McKinley ..... E04B 1/2608 52/639
2,943,716 A * 7/1960 Babcock ..... E04B 1/24 52/653.1
3,691,712 A 9/1972 Bowling et al.
3,938,297 A * 2/1976 Sato ..... E04B 1/2403 403/188
3,952,472 A 4/1976 Boehmig
4,074,947 A 2/1978 Matake et al.
4,211,045 A 7/1980 Koizumi et al.
4,409,765 A 10/1983 Pall
4,441,289 A 4/1984 Ikuo et al.
5,148,642 A 9/1992 Plumier et al.
5,253,465 A * 10/1993 Gilb ..... E04B 1/2612 403/170
5,263,296 A 11/1993 Spera
5,402,614 A * 4/1995 Jewell ..... E02D 27/32 248/505
5,577,353 A 11/1996 Simpson
5,660,017 A 8/1997 Houghton
5,680,738 A * 10/1997 Allen ..... E04B 1/2403 52/837
5,806,265 A 9/1998 Sluiter
6,022,165 A 2/2000 Lin
6,073,405 A 6/2000 Kasai et al.
6,138,427 A 6/2000 Houghton
6,158,184 A * 12/2000 Timmerman, Sr. ... E04B 1/0007 52/293.3
6,237,303 B1 5/2001 Allen et al.
6,516,583 B1 2/2003 Houghton
6,591,573 B2 7/2003 Hougton
6,802,169 B2 * 10/2004 Simmons ..... E04B 1/24 403/170
6,837,010 B2 1/2005 Powell et al.
6,993,880 B2 2/2006 Cameron et al.
7,076,926 B2 7/2006 Kasai et al.
7,127,863 B2 10/2006 Simmons
7,225,588 B2 6/2007 Nakamura et al.
7,703,244 B2 4/2010 Suzuki et al.
7,784,226 B2 8/2010 Ichikawa et al.
7,941,985 B2 5/2011 Simmons
8,122,671 B2 2/2012 Karns
8,146,322 B2 4/2012 Karns
8,205,408 B2 6/2012 Houghton et al.
8,375,652 B2 2/2013 Hiriyur et al.
8,468,775 B2 6/2013 Vaughn
8,505,260 B1 8/2013 Chang et al.
8,925,278 B2 * 1/2015 Sugihara ..... E04B 1/58 52/167.3
9,514,907 B2 * 12/2016 McManus ..... H01H 85/0017
9,670,676 B2 * 6/2017 Sirowatka ..... E04C 3/16
2002/0020141 A1 * 2/2002 Payer ..... E04B 1/24 52/741.11
2002/0046514 A1 * 4/2002 Leung ..... E04B 1/10 52/167.3
2002/0124520 A1 * 9/2002 Bock ..... E04B 1/2403 52/655.1
2003/0009977 A1 1/2003 Houghton
2003/0203008 A1 10/2003 Gunasekaran
2003/0205008 A1 * 11/2003 Sridhara ..... E04H 9/02 52/167.3
2003/0208985 A1 11/2003 Allen et al.
2004/0244330 A1 12/2004 Takeuchi et al.
2005/0204684 A1 9/2005 Houghton
2006/0101733 A1 * 5/2006 Jen ..... E04H 9/02 52/167.1
2006/0112652 A1 6/2006 Ichikawa et al.
2007/0209314 A1 9/2007 Vaughn
2007/0245643 A1 10/2007 Ichikawa et al.
2007/0253766 A1 11/2007 Packer et al.
2007/0261356 A1 11/2007 Vaughn
2008/0289267 A1 11/2008 Sarkisian
2009/0025308 A1 1/2009 Deans et al.
2009/0165419 A1 7/2009 Richard et al.
2009/0223166 A1 9/2009 Ohata et al.
2010/0031587 A1 2/2010 Weeks
2010/0043338 A1 * 2/2010 Houghton ..... E04B 1/24 52/653.1
2010/0043347 A1 * 2/2010 Houghton ..... E04B 1/24 52/831
2010/0043348 A1 * 2/2010 Houghton ..... E04B 1/24 52/846
2011/0252743 A1 1/2011 Yang
2011/0030305 A1 2/2011 Karns
2011/0047925 A1 3/2011 Gan
2012/0009009 A1 1/2012 Bub
2012/0017523 A1 1/2012 Ozaki et al.
2012/0062648 A1 3/2012 Tanaka et al.
2013/0168626 A1 7/2013 Blinn
2014/0020311 A1 * 1/2014 Richard ..... E04B 1/24 52/167.3
2014/0062648 A1 3/2014 McManus et al.
2014/0083046 A1 3/2014 Yang
2014/0182234 A1 * 7/2014 Yang ..... E04B 1/24 52/655.1
2014/0182236 A1 7/2014 Doupe et al.
2014/0318075 A1 10/2014 Shubaibar
2014/0325932 A1 11/2014 Tran et al.
2015/0218838 A1 * 8/2015 Ichikawa ..... E04H 9/021 52/167.3
2015/0275501 A1 10/2015 Houghton
2016/0002910 A1 * 1/2016 Green ..... F16B 7/042 52/848
2016/0356033 A1 * 12/2016 Houghton ..... E04B 1/2403
2017/0314254 A1 * 11/2017 Houghton ..... E04B 1/1912

FOREIGN PATENT DOCUMENTS

JP 2007169983 A 7/2007
WO 2004067869 A2 8/2004
WO 2012112608 A1 8/2012
WO 2014085680 6/2014

OTHER PUBLICATIONS

American Institute of Steel Construction, Steel Design Guide 4, Extended End-Plate Moment Connections, Seismic and Wind Applications, Second Edition, 166 pages, 2003, United States.
American Institute of Steel Construction, Steel Design Guide Series 16, Flush and Extended Multiple Row, Moment End-Plate Connections, 74 pages, 2002, United States.
Atsushi Sato, et al., Cyclic Behavior and Seismic Design of Bolted Flange Plate Steel Moment Connections, Engineering Journal, Fourth Quarter, 2008, pp. 221-232, United States.
Simpson, Strong Tie, Introduction to the Strong Frame® Special Moment Frame, http://www.strongtie.com/products/strongframe/special_mf/intro.asp, 2014, 3 pages, United States.
Invitation to Pay Additional Fees and, where Applicable, Protest Fees for PCT Application No. PCT/IB2016/053199, dated Jul. 22, 2016, 7 pages.
International Search Report and Written Opinion for PCT Application No. PCT/IB2016/053199, dated Sep. 12, 2016, 17 pages.
Non-Final Rejection, U.S. Appl. No. 14/729,995, dated Aug. 21, 2015, 10 pages.

(56) References Cited

OTHER PUBLICATIONS

Final Rejection, U.S. Appl. No. 14/729,995, dated Apr. 4, 2016, 6 pages.
Non-Final Rejection, U.S. Appl. No. 14/729,995, dated Oct. 31, 2016, 10 pages.
Non-Final Rejection, U.S. Appl. No. 14/729,995, dated Aug. 1, 2017, 19 pages.
Final Rejection, U.S. Appl. No. 14/729,995, dated Nov. 22, 2017, 18 pages.
Non-Final Rejection, U.S. Appl. No. 14/729,995, dated Apr. 2, 2018, 17 pages.
Final Rejection, U.S. Appl. No. 14/729,995, dated Aug. 10, 2018, 28 pages.
United Kingdom Examination Report under Section 18(3) for GB1717740.3 dated May 19, 2020, 2 pages, United Kingdom.

* cited by examiner

GUSSET PLATE CONNECTION OF BRACED BEAM TO COLUMN

CROSS-REFERENCE TO RELATED APPLICATION

This application is a continuation of U.S. Ser. No. 14/729,995, filed Jun. 3, 2015, the entire contents of which are incorporated herein by reference.

FIELD OF THE INVENTION

The present invention generally relates to a moment resisting, beam-to-column joint connection structure, and more particularly to an all field-bolted dual braced/moment resisting frame, beam-to-column-to-diagonal brace joint connection structure, and including an optional adjustable beam seat to facilitate alignment of bolt holes during erection of a moment resisting, beam-to-column joint connection structure.

BACKGROUND OF THE INVENTION

It has been found in a moment-resisting building having a structural steel framework, that most of the energy of an earthquake, or other extreme loading condition, is absorbed and dissipated, in or near the beam-to-column joints of the building. Braced structural connection systems including a brace-to-column and brace-to-beam joint connection must also be capable of withstanding loads generated during an earthquake, or other extreme loading condition.

In the structural steel construction of moment-resisting buildings, towers, and similar structures, most commonly in the past, the flanges of beams were welded to the face of columns by full-penetration, single bevel, groove welds. Thus, the joint connection was comprised of highly-restrained welds connecting a beam between successive columns. Vertical loads, that is, the weight of the floors and loads superimposed on the floors, were and still are assumed by many to be carried by vertical shear tabs or pairs of vertical, structural angle irons arranged back-to-back, bolted or welded to the web of the beam and bolted or welded to the face of the column.

The greater part of the vertical load placed upon a beam was commonly assumed to be carried by a shear tab bolted or welded to the web of the beam and bolted or welded to the face of the flange of the column at each end of the beam. Through the use of parallel face-to-face gusset plates welded to the column, the entire vertical load is carried by the gusset plates.

Experience has shown that the practice of welding the beam's flanges directly to the column flange using full penetration, single bevel groove welds is uncertain and/or unsuitable for resistance to earthquakes, explosions, tornadoes and other disastrous events, and must rely on highly experience welders which severely limits its application to being used in only certain regions of the world where pre-qualified welding capability is readily available and/or is the preferred construction means of that region or particular industry. Such connection means and welding practice has resulted in sudden, fractured welds, the pulling of divots from the face of the column flange, cracks in the column flange and column web, and various other failures. Such highly-restrained welds do not provide a reliable mechanism for dissipation of earthquake energy, or other large forces, and can lead to brittle fracture of the weld and the column, particularly the flange of the column and the web of the column in the locality of the beam-to-column joint, (known as the "panel zone").

It is desirable to achieve greater strength, ductility and joint rotational capacity in beam-to-column connections in order to make buildings less vulnerable to disastrous events. Greater connection strength, ductility and joint rotational capacity are particularly desirable in resisting sizeable moments. That is, the beam-to-column moment-resisting connections in a steel frame building can be subjected to large rotational demands due to interstory lateral building drift. Engineering analysis, design and full-scale specimen testing have determined that prior steel frame connection techniques can be substantially improved by strengthening the beam-to-column connection in a way which better resists and withstands the sizeable beam-to-column, joint rotations which are placed upon the beam and the column. That is, the beam-to-column connection must be a strong and ductile, moment-resisting connection.

The parallel gusset plates may also be configured to receive diagonal braces. Thus, wherein the brace, column, and beam are connected by parallel gusset plates, the system is a "dual" system because it uses gusset plates to attach both beams and diagonal braces to columns, thereby combining, interactively, a structurally braced, highly ductile lateral load resisting connection system with a highly ductile structural moment resisting frame connection system to form a redundant structural lateral load resisting system.

Reference is made to co-assigned U.S. Pat. Nos. 5,660,017, 6,138,427, 6,516,583, and 8,205,408 (Houghton et al.) for further discussion of prior practice and the improvement of the structural connection between beams and columns through the use of gusset plates. These patents illustrate the improvements that have been manifested commercially in the construction industry by Houghton and others in side plate technology. Initially, side plate construction was introduced to greatly improve the quality of the beam-to-column connection. Further improvements included the provision of side plate technology using full length beams to achieve greater economy and to facilitate more conventional erection techniques.

SUMMARY

In one aspect, a joint connection structure of a building framework generally comprises a column assembly including a column and a pair of gusset plates connected to the column on opposite sides of the column and extending laterally outward from the column. A full-length beam assembly includes a full-length beam having upper and lower flanges and an end portion received between the gusset plates. The full-length beam is bolted to the gusset plates of the column assembly to connect the full-length beam assembly to the column assembly. A brace has an end portion received between the gusset plates and makes an angle with the beam and with the column. The brace is bolted to the gusset plates at the end portion of the brace.

In another aspect, a joint connection structure of a building framework generally comprises a column assembly including a column and a pair of gusset plates connected to the column on opposite sides of the column and extending laterally outward from the column. A full-length beam assembly includes a full-length beam having upper and lower flanges and an end portion received between the gusset plates. An adjustable beam seat is attached to the column and supports the full-length beam assembly at least partially between the gusset plates. The adjustable beam seat is configured to move the full-length beam assembly relative to the gusset plates prior to permanent attachment of the full-length beam assembly to the column assembly.

BRIEF DESCRIPTION OF THE DRAWINGS

FIG. 8 is a front view of a dual braced/moment resisting frame, beam-to-column-to-diagonal brace joint connection structure of a second embodiment with all bolts removed to show the openings they extend through;

FIG. 10 is a front view of a dual braced/moment resisting frame, beam-to-column-to-diagonal brace joint connection structure of a third embodiment with bolts connecting a gusset plate to the beam assembly and to a brace removed to illustrate the openings they would extend through;

Corresponding reference characters indicate corresponding parts throughout the drawings.

DESCRIPTION OF THE PREFERRED EMBODIMENTS

Figure 5:
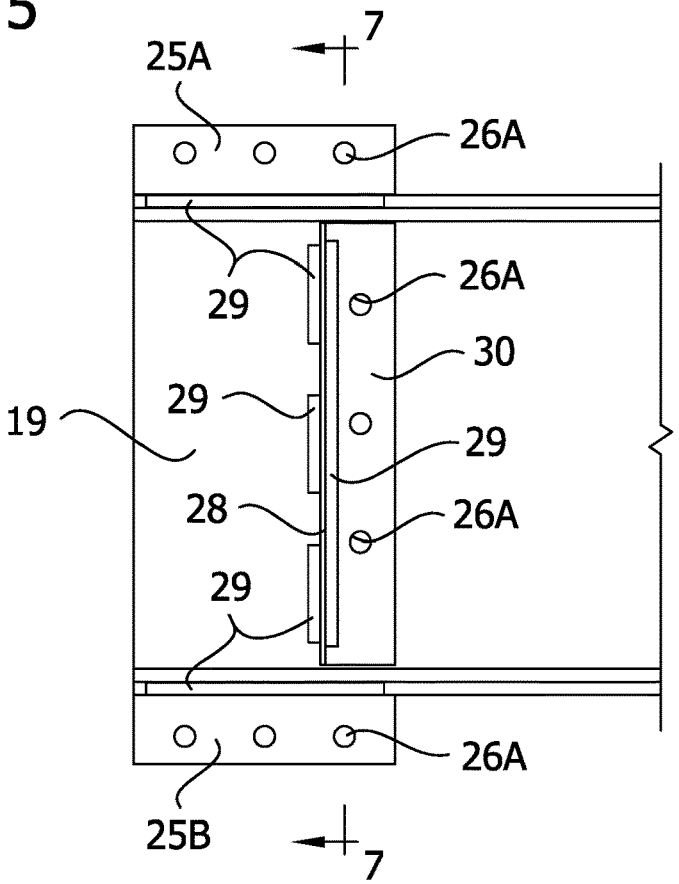
FIG. 5 is a front view of the full-length beam assembly in FIG. 4.
Figure 6:
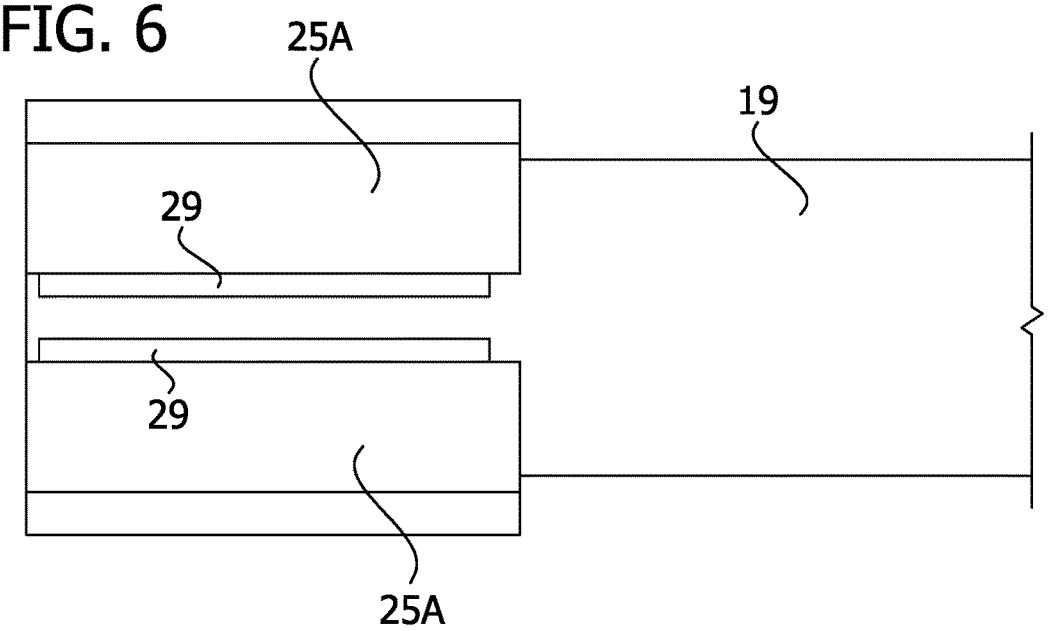
FIG. 6 is a top view of the full-length beam assembly in FIG. 4.
Figure 16:
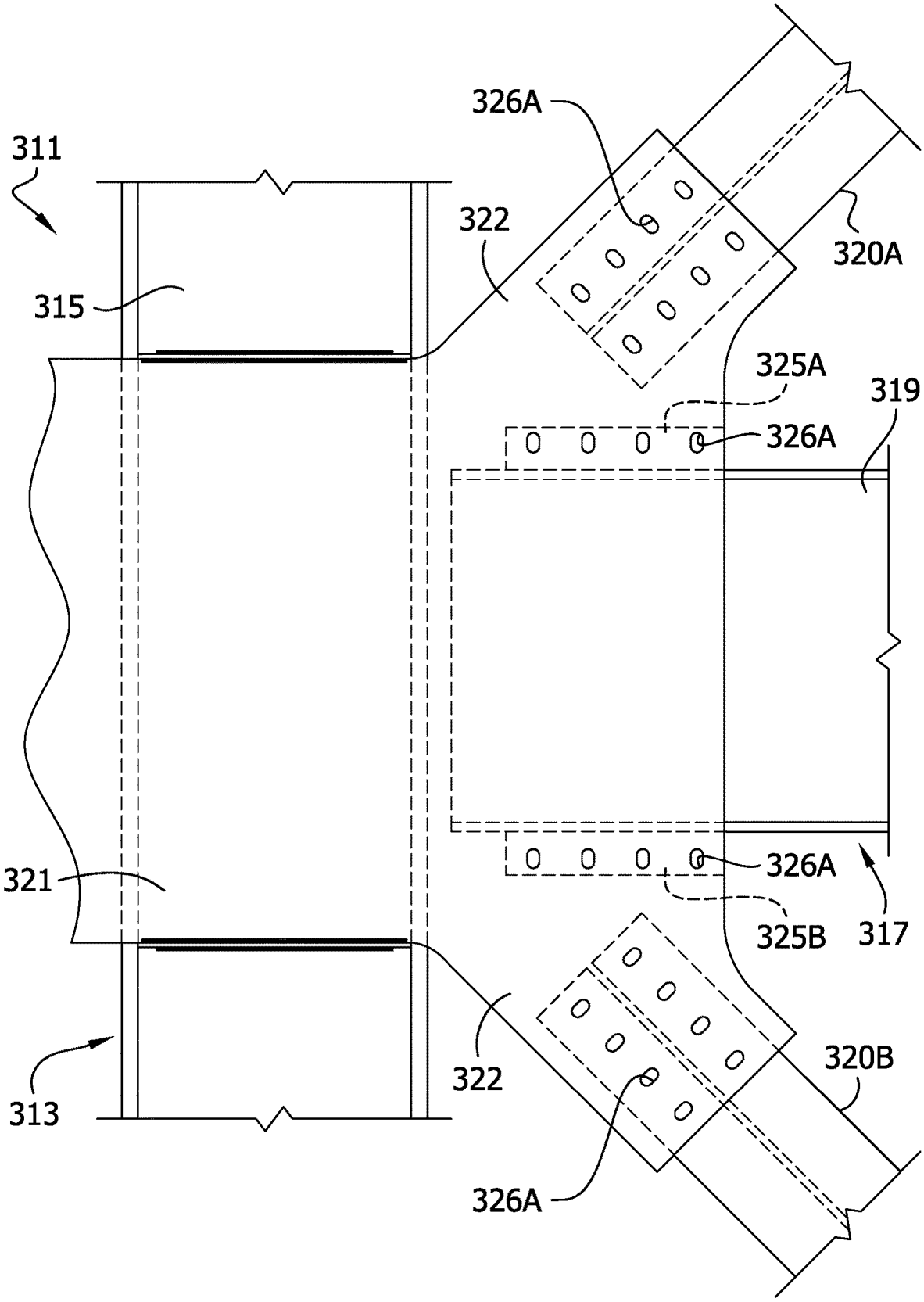
FIG. 16 is a front view of a dual braced/moment resisting frame, beam-to-column-to-diagonal brace joint connection structure of a fourth embodiment with bolts connecting gusset plates to a beam assembly and a brace removed to show the openings through which they would extend.

Referring to FIGS. 1-7, an all field-bolted dual braced/moment resisting frame, beam-to-column-to-diagonal brace joint connection structure of a first embodiment is generally indicated at 11. The joint connection structure may be used in the construction of a building framework 1 (see FIG. 1A). In the illustrated embodiment, the joint connection structure joins a column assembly 13 including a column 15 to a full-length beam assembly 17 including a full-length beam 19, and also a brace 20 to the column assembly. The brace 20 extends between the column 15 and beam 19 at an angle. A full-length beam is a beam that has a length sufficient to extend substantially the full-length between adjacent columns in a structure. Thus, a stub and link beam assembly as shown in FIGS. 5 and 16 of U.S. Pat. No. 6,138,427, herein incorporated by reference, is not a full-length beam. It is understood that the joint connection structure may include a beam-to-column type as shown, or a beam-to-column-to-beam type as shown in U.S. Pat. No. 8,146,322, herein incorporated by reference, depending upon the location of the joint connection structure within a building's framework.

Figure 1:
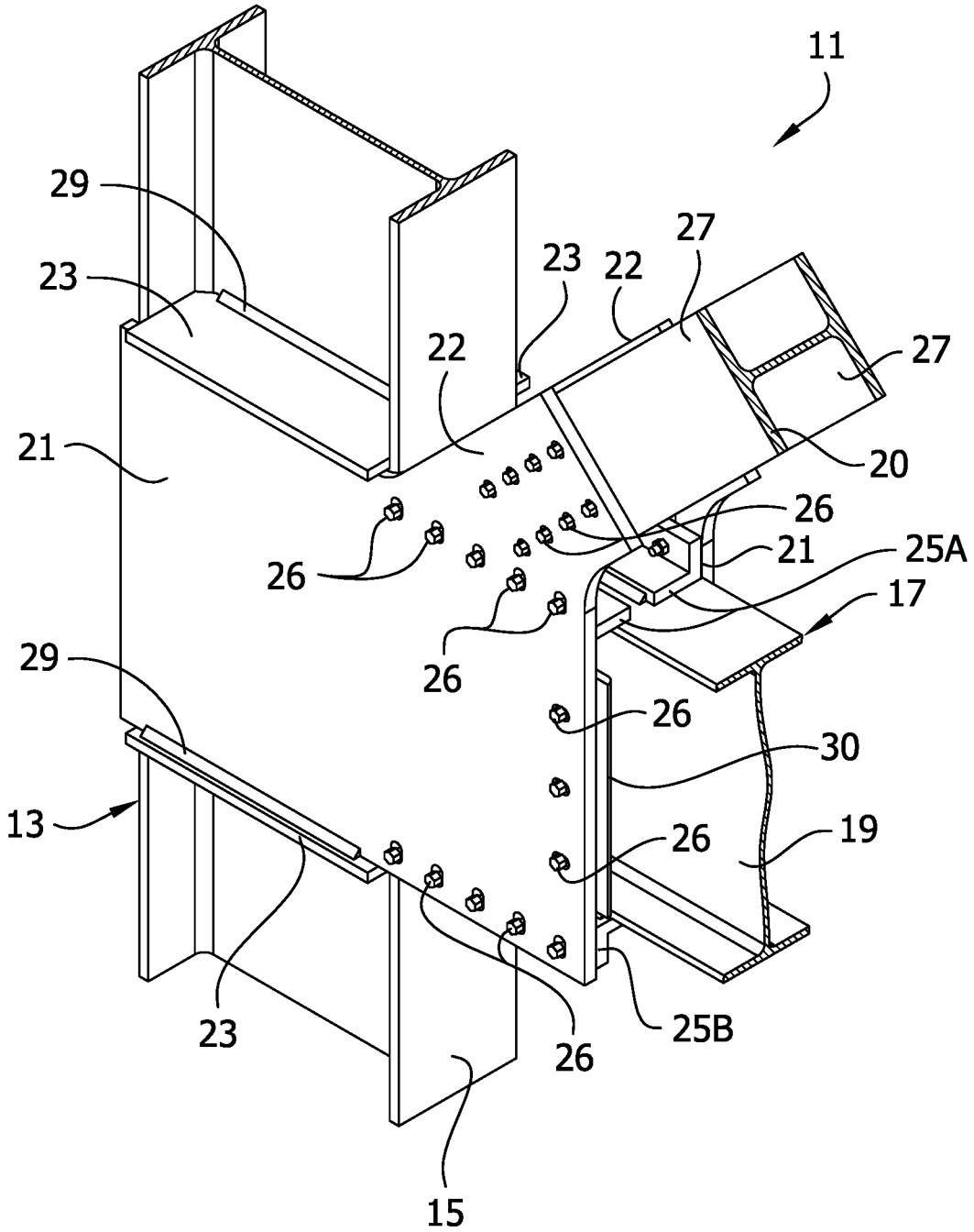
FIG. 1 is a fragmentary perspective of a dual braced/moment resisting frame, beam-to-column-to-diagonal brace joint connection structure of a first embodiment.

The beam 19, column 15, and brace 20 may have any suitable configuration, such as an I-beam, H-beam configuration, or hollow rectangular shape (built up box member or HSS tube section). A spaced apart pair of parallel, vertically and horizontally extending gusset plates 21 sandwich the column 15, beam 19, and brace 20. An extension 22 at an upper portion of the gusset plates 21 receives the brace 20. Four optional horizontal shear plates 23 (only three are shown in FIG. 1) are arranged in vertically spaced pairs generally aligned at top and bottom edges of the gusset plates 21. Two angle irons (broadly, "connecting members") 25A are disposed on an upper flange of the beam 19 at an end of the beam (see, FIG. 7). The angle irons 25A are horizontally spaced from one another and extend along a length of an end portion of the beam 19, and are located on opposite longitudinal edge margins of the beam. The angle irons 25A connect the gusset plates 21 to the upper flange of the beam 19. The angle irons 25A are L-shaped in cross section. Each angle iron 25A may include a horizontal first leg attached to the upper flange of the beam 19 and a vertical second leg projecting from the first leg perpendicular to the length of the beam. The first leg is attached in a suitable manner such as by a weld 29 between the toe of the first leg and the top surface of the upper flange of the beam 19 and by a weld 29 on the underside of the first leg to the tips of the upper flange. An outer surface of the second leg of each angle iron 25A is bolted to an inner surface of a respective gusset plate 21 by horizontally spaced bolts 26 extending through aligned bolt holes 26A in the second leg of the angle iron and respective gusset plate. Instead of two angle irons 25A for example, a single channel welded to the top flange could be employed.

Flanges 27 of the brace 20 are bolted to the inner surface of a respective gusset plate 21 by diagonally spaced bolts 26 extending through aligned bolt holes 26A in the flange of the brace and the respective gusset plate. In the illustrated embodiment, there are two rows of diagonally spaced bolt holes 26A in each flange 27 located on opposite sides of a web of the brace 20 that receive the bolts 26 and connect the brace to the respective gusset plate.

Figure 7:
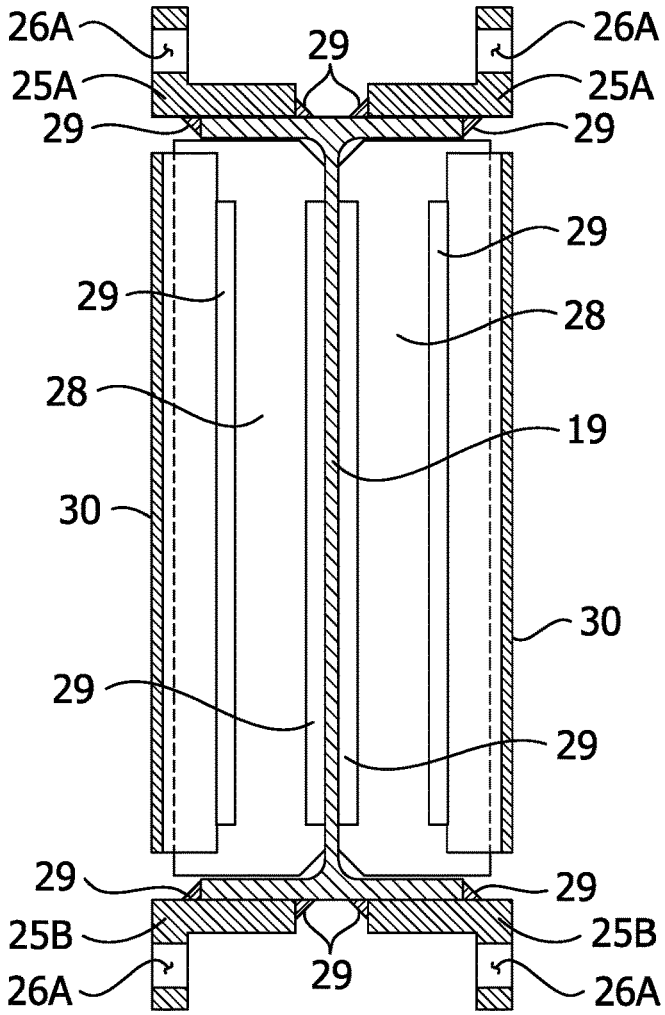
FIG. 7 is a section taken in the plane including line 7-7 of FIG. 5.

Vertical shear plates 28 are welded at 29 to a web of the beam 19 and bolted to the gusset plates 21 by way of vertical angle irons 30 attached to the vertical shear plates (FIG. 7). Each of the vertical angle irons 30 is attached in a suitable manner such as by welds 29 at the toe and heel of the leg of the vertical angle iron 30 abutting the vertical shear plate 28. The vertical angle irons 30 are L-shaped in vertical plan view. Each vertical angle iron 30 may include a vertically extending first leg welded to a corresponding vertical shear plate 28 and a second vertically extending leg projecting perpendicular to the first leg along the length of the beam. An outer surface of the second leg of each angle iron 30 is bolted to an inner surface of a respective gusset plate 21 by vertically spaced bolts 26 extending through aligned bolt holes 26A in the second leg of the angle iron 30 and respective gusset plate to connect the web of the beam 19 to the gusset plate. The vertical shear plates 28 and angle irons 30 are optional.

Two angle irons (broadly, "connecting members") 25B are disposed on a lower flange of the beam 19 at an end of the beam (see, FIG. 7). The angle irons 25B are horizontally spaced from one another, extend along a length of an end portion of the beam, and are located along opposite longitudinal edge margins of the beam 19. The angle irons 25B connect the gusset plates 21 to the lower flange of the beam 19. The angle irons 25B are L-shaped in cross section. Each angle iron 25B may include a horizontal first leg attached to the lower flange of the beam 19 and a vertical second leg projecting from the first leg perpendicular to the length of the beam. The first leg is attached in a suitable manner to the bottom face of the lower flange of the beam 19 such as by a weld 29 between a toe of the first leg and the bottom surface of the lower flange of the beam 19 and a weld 29 between a top surface of the first leg and a tip of the lower flange. An outer surface of the second leg of each angle iron 25B is bolted to an inner surface of a respective gusset plate 21 by horizontally spaced bolts 26 extending through aligned bolt holes 26A in the second leg of the angle iron and respective gusset plate. Instead of two angle irons 25B a single channel welded to the lower flange could be employed. Moreover, different combinations of connecting structure could be used. For example, one flange of the beam 19 might use two angle irons, while the other flange of the beam uses a channel.

The bolt holes 26A in the gusset plates 21 may be larger than the bolt holes 26A in the angle irons 25A, 25B, 30 to facilitate placement of one or more of the bolts 26 through slightly misaligned holes 26A. In particular, the bolt holes 26A in the angle irons 25A, 25B could be standard size and the bolt holes 26A in the gusset plates 21 associated with the bolt holes in the angle irons 25A, 25B could be vertically slotted (as shown) such that a first dimension of the bolt holes that extends generally parallel to a longitudinal axis of the column 15 is greater than a second dimension of the bolt holes that extends generally perpendicular to the longitudinal axis of the column. The bolts 26 are inserted first through the standard sized holes in the angle irons 25A, 25B and then into the associated slotted bolt holes 26A of the gusset plates 21. Similarly, the bolt holes 26A in the angle irons 30 could be standard size and the bolt holes 26A in the gusset plates 21 associated with the bolt holes in the angle irons 30 could be horizontally slotted (as shown) such that a first dimension of the bolt holes that extends generally parallel to a longitudinal axis of the beam 19 is greater than a second dimension of the bolt holes that extends generally perpendicular to the longitudinal axis of the beam. The bolts 26 are inserted first through the standard sized holes in the angle irons 30 and then into the associated slotted bolt holes 26A of the gusset plates 21. The bolt holes 26A in the gusset plates 21 associated with the bolt holes in the brace 20 may have a different configuration than the bolt holes in the brace. In particular, the bolt holes 26A in the brace could be standard size and the bolt holes 26A in the gusset plates 21 associated with the bolt holes in the brace could be diagonally slotted (as shown) such that a first dimension of the bolt holes that extends generally perpendicular to a longitudinal axis of the brace 20 is greater than a second dimension of the bolt holes that extends generally parallel to the longitudinal axis of the brace. The bolts 26 are inserted first through the standard sized holes in the brace 20 and then into associated bolt holes 26A in the gusset plates 21. It will be appreciated that similar slotting of one of two mating holes may be used to facilitate bolting the components together in all the disclosed embodiments. Moreover, the holes 26A in the angle irons 25A, 25B may be slotted and the holes 26A in the gusset plates 21 may be standard within the scope of the present invention. Similarly, the bolt holes in the brace 20 may be slotted and the holes 26A in the gusset plates 21 may be standard. The bolt connection structure of this invention allows workers in the field to draw the gusset plates 21 into flush engagement with the angle irons 25A, 25B, 30 even with an initial gap between the gusset plates and full-length beam assembly 17, without the need of an external clamping structure.

Referring to FIGS. 4-7, the full-length beam assembly 17 may be fabricated at a fabrication shop prior to being transported to the construction site. To fabricate the full-length beam assembly 17, the angle irons 25A, 25B are welded at 29 or otherwise attached to the upper and lower flanges of the beam 19. Additionally, the vertical shear plates 28 and angle irons 30 are welded or otherwise attached to the web of the beam 19. Any welds on the beam assembly needed to form the joint connection structure can be made at the shop so no welding is required at the work site. The angle irons 25A, 25B, and 30 may have other configurations than those illustrated in the current embodiment.

Figure 2:
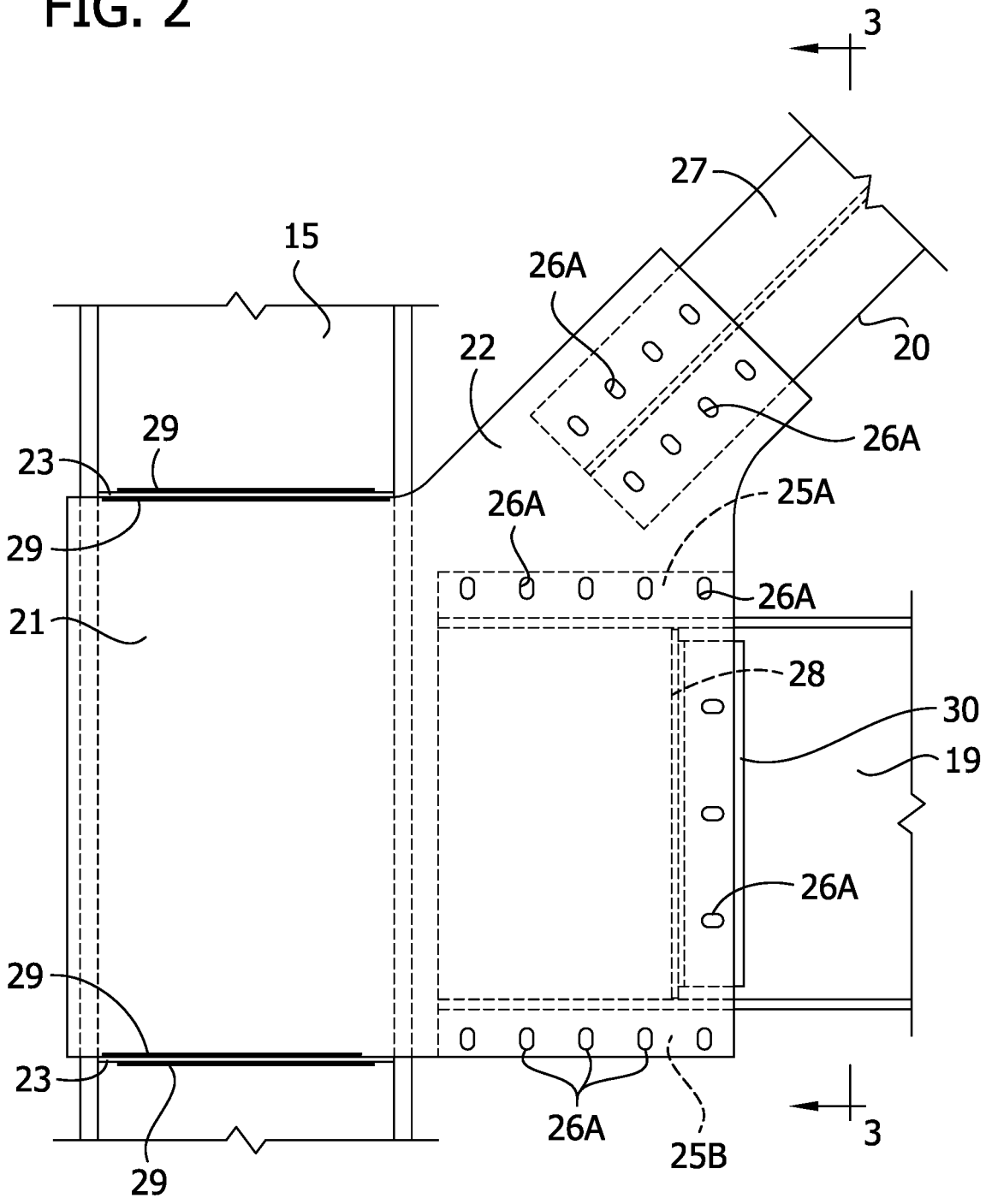
FIG. 2 is a front view of the dual braced/moment resisting frame, beam-to-column-to-diagonal brace joint connection structure of FIG. 1.
Figure 3:
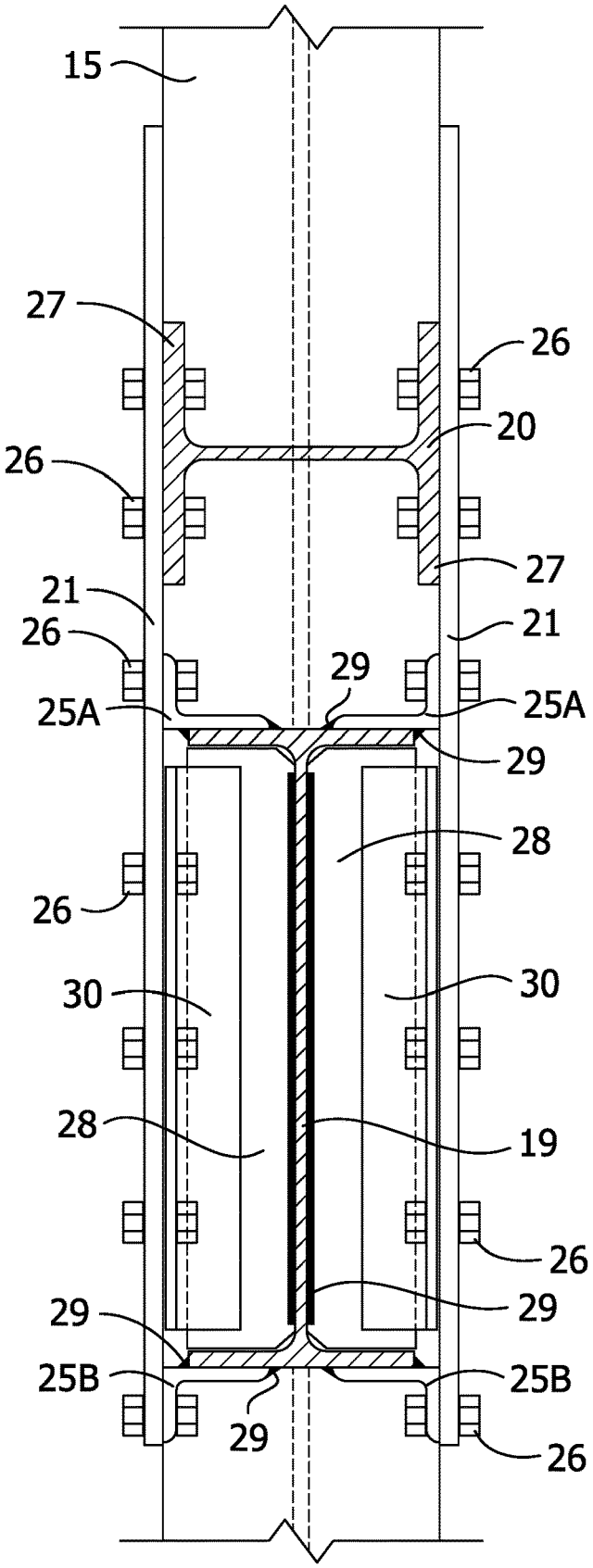
FIG. 3 is a section taken in the plane including line 3-3 of FIG. 2.
Figure 4:
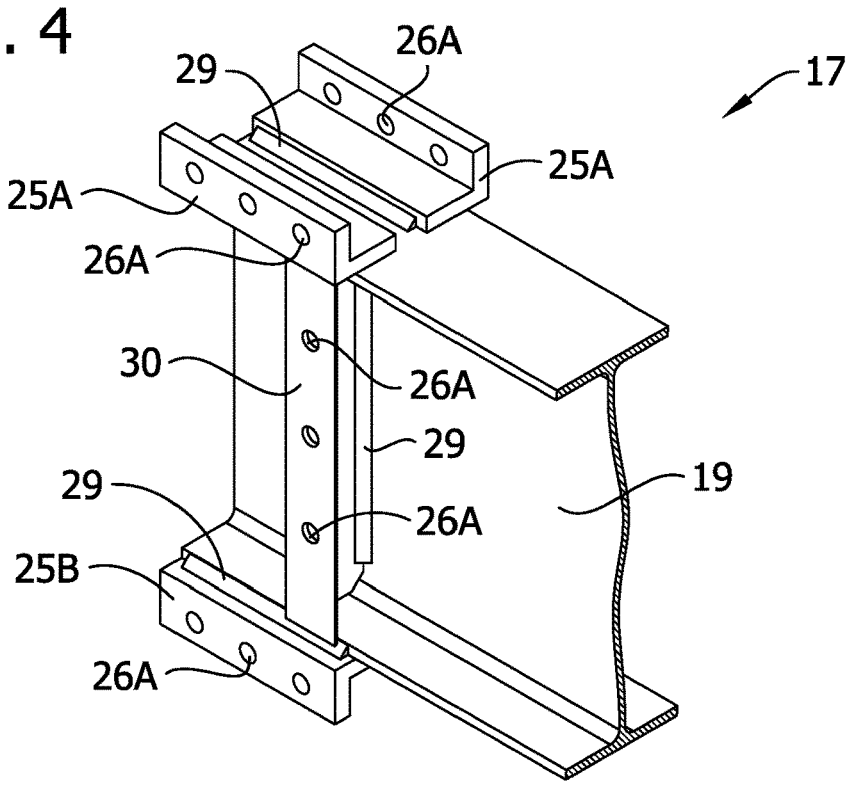
FIG. 4 is a fragmentary perspective of a full-length beam assembly of the dual braced/moment resisting frame, beam-to-column-to-diagonal brace joint connection structure of FIG. 1.

Referring to FIGS. 1-3, the column assembly 13 may also be fabricated at a fabrication shop and later transported to the construction site. To fabricate the column assembly 13, the gusset plates 21 are welded at 29 to optional horizontal shear plates 23, and also welded to the flanges of column 15 along longitudinal edge margins of the column. The optional horizontal shear plates 23 are welded at 29 or otherwise attached to the web of the column and to the top and bottom edges of the gusset plates. Any welds on the column assembly 13 needed to form the braced beam-to-column moment-resisting joint may be carried out at the shop. The horizontal shear plates 23 can be omitted from the column assembly 13. The gusset plates 21 can have other configurations than those illustrated in the current embodiment.

At the construction site, the column assembly 13 is joined to the full-length beam assembly 17 and the brace 20 is joined to the column assembly and full-length beam assembly. The column assembly 13 is first erected in a vertical orientation and the end of the full-length beam assembly 17 is positioned horizontally and adjacent to the column assembly, over the gusset plates 21. The full-length beam assembly 17 is then lowered between the gusset plates 21 so that the gusset plates are disposed on opposite sides of the beam 19 and angle irons 25A, 25B of the full-length beam assembly 17. To fixedly secure the two assemblies 13, 17, horizontally spaced bolts 26 are used to attach the gusset plates 21 to the angle irons 25A, 25B through aligned bolt holes in the respective components. Vertically spaced bolts 26 are used to attach the gusset plates 21 to the angles irons 30 welded to the web of the beam 19. The brace 20 is then lowered between the extensions 22 of the gusset plates 21 so that the extensions are disposed on opposite sides of the brace. Diagonally spaced bolts 26 are used to attach the gusset plates 21 to the brace 20. Thus, at the construction site, the dual braced/moment resisting frame, beam-to-column-to-diagonal brace joint connection structure 11 is completed exclusively through bolt connections. In the field, the dual braced/moment resisting frame, beam-to-column-to-diagonal brace joint connection structure 11 is constructed without the use of welds. The joint connection structure 11 can be used if the building frame is dimensionally close to the exterior curtain wall of the building because the angle irons 25A, 25B are on the inside of the gusset plates 21.

The joint connection structure 11 outlined above is a dual braced/moment resisting frame, beam-to-column-to-diagonal brace joint connection structure. It will be understood by a person having ordinary skill in the art that a braced beam-to-column-to-beam type structure may have additional analogous components. Most preferably, each of the components of the joint connection structure 11, as well as the beam 19, column 15, and brace 20, are made of structural steel. Some of the components of the joint connection structure 11 are united by welding and some by bolting. The welding may be initially performed at a fabrication shop. The bolting may be performed at the construction site, which is the preferred option in many regions of the world.

The bolted joint connection structure of the present invention also increases construction tolerance for misalignment of components during field steel frame erection because of the novel slotting orientation of the bolt holes 26A in which some are elongated in a vertical direction and others are elongated in a horizontal direction that is transverse to the longitudinal axis of the beam 19.

Unlike oversized holes requiring the use of slip-critical bolts, the slotted bolt holes 26A are larger than standard bolt holes in only one direction. Also, the slot direction of the bolt holes 26A associated with angle irons 25A, 25B is perpendicular to the direction of load, that is, does not extend along the longitudinal axis of the beam 19. Instead, the slots of the bolt holes 26A associated with the angle irons 25A, 26B extend perpendicular (broadly, "transverse") to the longitudinal axis of the beam 19 so that when the joint connection structure 11 is loaded, and in particular when the beam is loaded axially along its length or about its major axis in bending, a gap is not formed between the bolts 26 and their respective bolt holes 26A (i.e., no slip of bolt occurs because bolts 26 are already loaded by direct bearing in shear). As used herein "transverse" to the longitudinal axis of the beam 19 means any direction that crosses over the longitudinal axis of the beam and is not parallel to the longitudinal axis of the beam. In some embodiments, the bolt holes 26A have a slotted dimension that is up to about 2.5 times the diameter of the bolt 26. In some embodiments, the bolt holes 26A have a slotted dimension that is from about 3/16 in. up to about 2¾ in. larger than the diameter of the bolt 26. In a preferred embodiment, the bolt holes 26A have a slotted dimension that is about ¾ in. larger than the diameter of the bolt 26.

The unique geometry and stiffness of this all shop fillet-welded and all field-bolted dual braced/moment resisting frame, beam-to-column-to-diagonal brace joint connection structure 11 maximizes its performance and the broadness of its design applications, including both extreme wind and moderate-to-severe seismic conditions. In particular, the all field-bolted joint connection structure 11 preserves the physical separation (or gap) between the end of a full-length beam 19 and the flange face of the column 15 made possible by the use of vertically and horizontally extended parallel gusset plates 21 that sandwich the column and the beam similar to prior designs which feature an all field fillet-welded joint connection structure; thus eliminating all of the uncertainty of bending moment load transfer between a rigidly attached steel moment frame beam and column used in the past.

Further, by including the vertically and horizontally extending parallel gusset plates 21 that sandwich both the column 15, beam 19, and brace 20, this current all field-bolted dual braced/moment resisting frame, beam-to-column-to-diagonal brace joint connection structure 11 preserves the advantage of increased beam-to-column joint stiffness, with a corresponding increase in overall steel moment frame stiffness. The dual system joint connection structure 11 combines a brace frame connection system and a beam frame connection system. The brace frame connection system and the beam frame connection system share the applied lateral load on the basis of relative system stiffnesses. This dual system stiffness joint connection structure 11 can result in smaller beam and brace sizes when the building design is controlled by lateral story drift (not member strength), and hence reduced material costs. The joint connection structure 11 results in reduced load demand on the braced frame lateral load resisting system, with corresponding smaller beam and brace sizes. When the building design is controlled by member strength (not lateral story drift), this all field-bolted dual braced/moment resisting frame, beam-to-column-to-diagonal brace joint connection structure 11 also permits reducing the beam size and column size, and hence material quantities and fabrication cost, at least in part because its connection geometry has no net section reduction in either the beam or the column (i.e., no bolt holes through either the beam or column), thereby maintaining the full strength of the beam and column.

In one aspect of the present disclosure, a full-length beam is connected to gusset plates by bolts so that the full-length beam and gusset plates are substantially free of welded connection. Additionally, a brace is connected to the gusset plates by bolts so that the brace and gusset plates are substantially free of welded connection. It will be understood that welding the column assembly 13 to the full-length beam assembly 17 and/or brace 20 is within the scope of that aspect of the disclosure.

Figure 8:
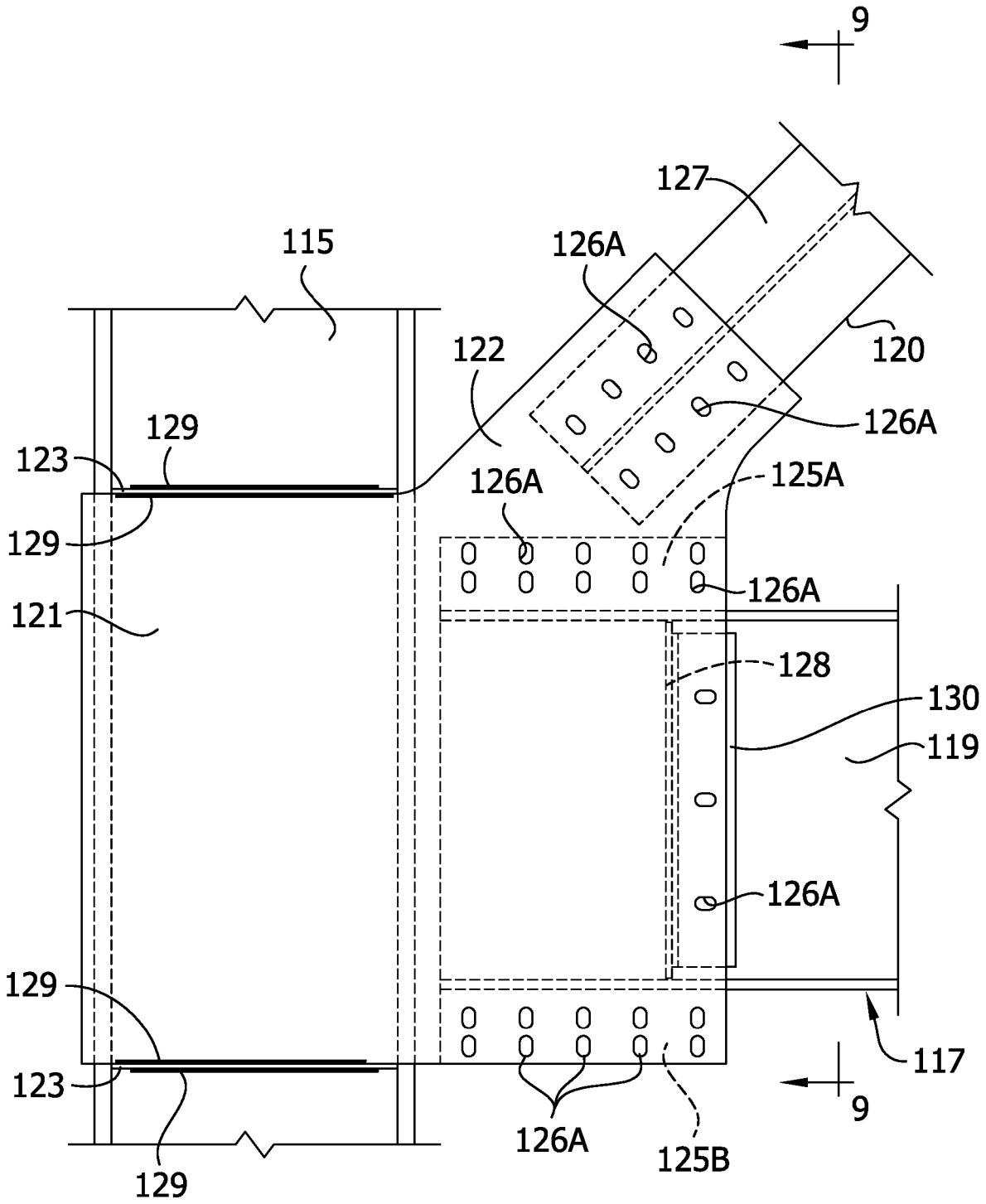
Figure 9:
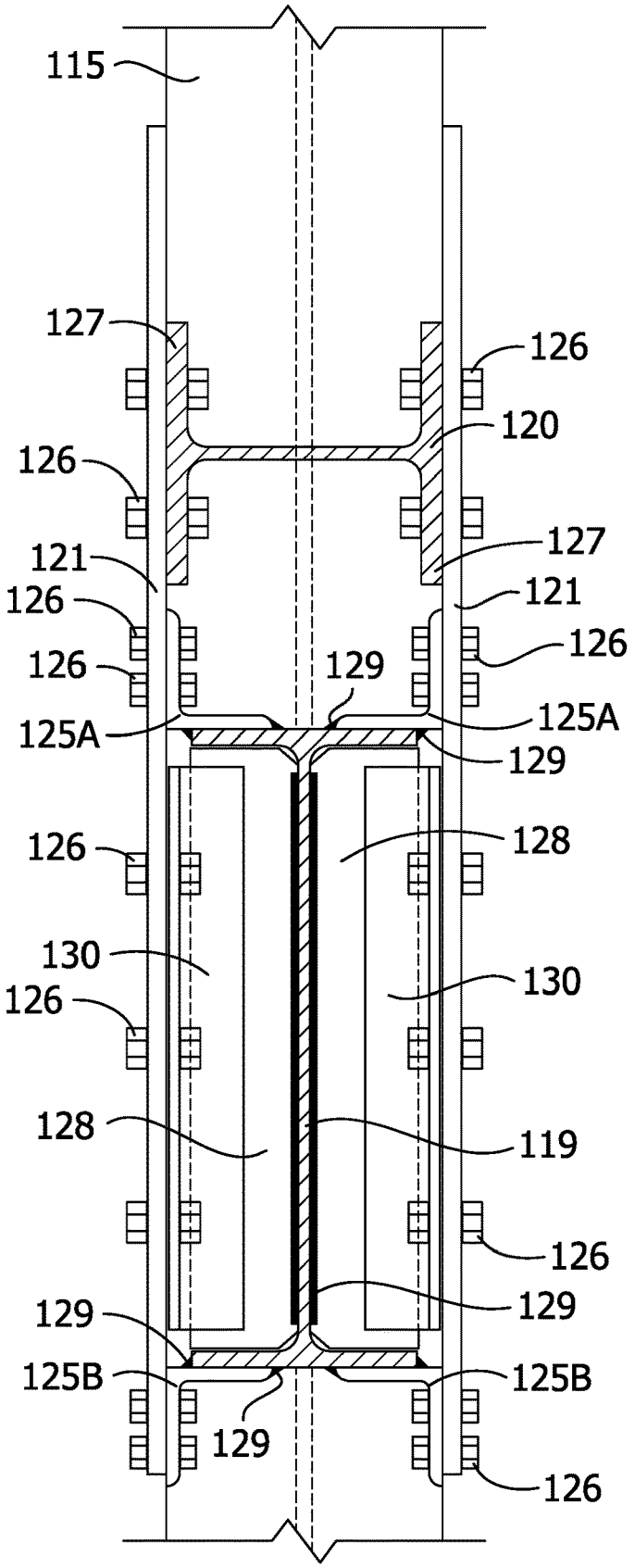
FIG. 9 is a section taken in the plane including line 9-9 of FIG. 8, but illustrating the bolts removed from FIG. 8.
Figure 10:
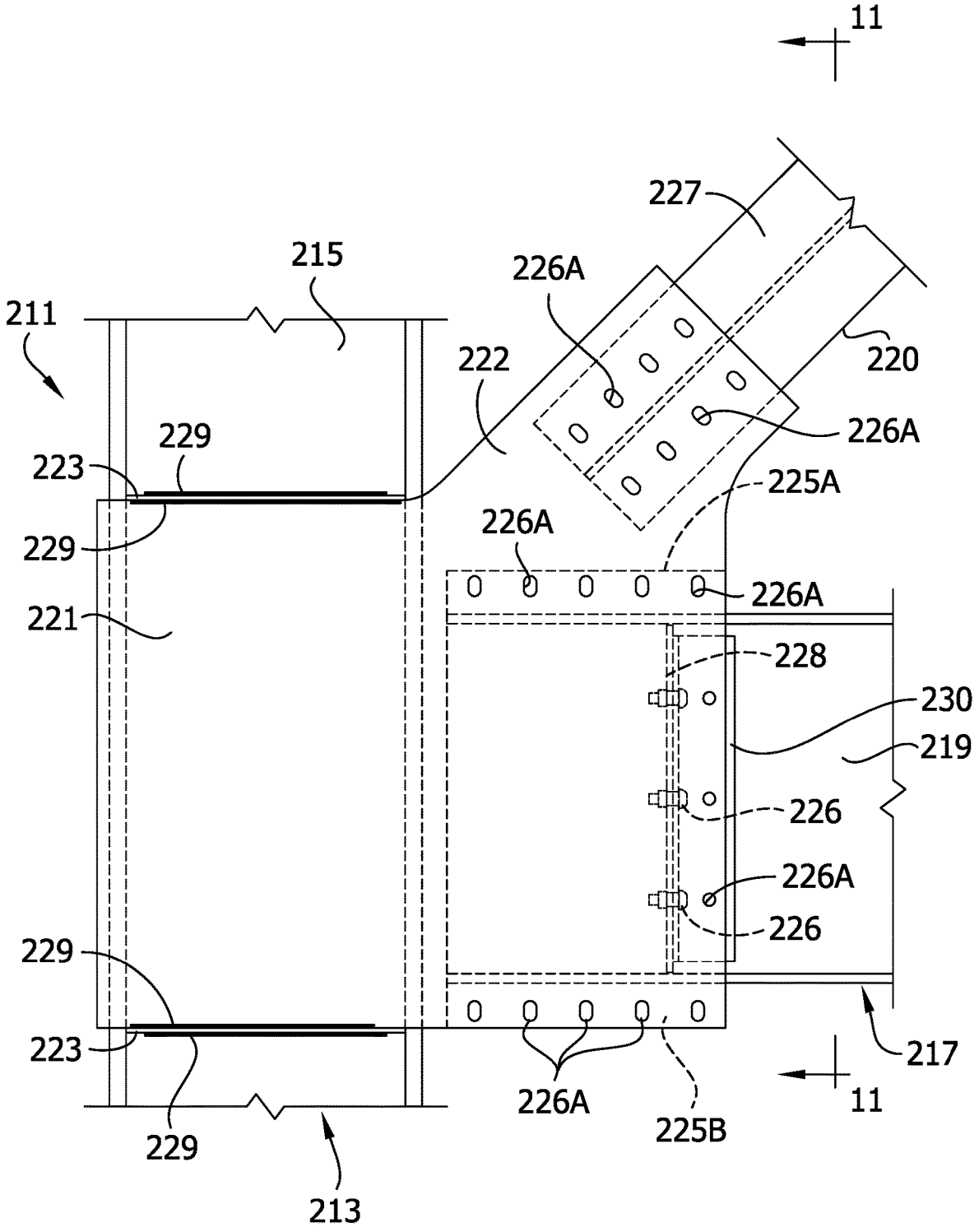

Referring to FIGS. 8 and 9, a dual braced/moment resisting frame, beam-to-column-to-diagonal brace joint connection structure of a second embodiment is generally indicated at 111. In the illustrated embodiment, the joint connection joins a column assembly 113 including a column 115 to a full-length beam assembly 117 including a full-length beam 119, and a brace 120 to the column assembly. The joint connection structure 111 of the second embodiment is substantially identical to the joint connection structure 11 of the first embodiment. The only differences between the two embodiments is gusset plates 121 have two rows of horizontally spaced bolt holes 126A associated with angle iron 125A, and two rows of horizontally spaced bolt holes 126A associated with angle iron 1258 for receiving bolts 126 to connect the gusset plates 121 to the beam assembly 117. It will be understood that vertical second legs of the angle irons 125A, 1258 may have a larger vertical dimension to accommodate for the two rows of bolt holes 126A. The bolt holes 126A in both rows may be slotted as described for bolt holes 26A.

Figure 11:
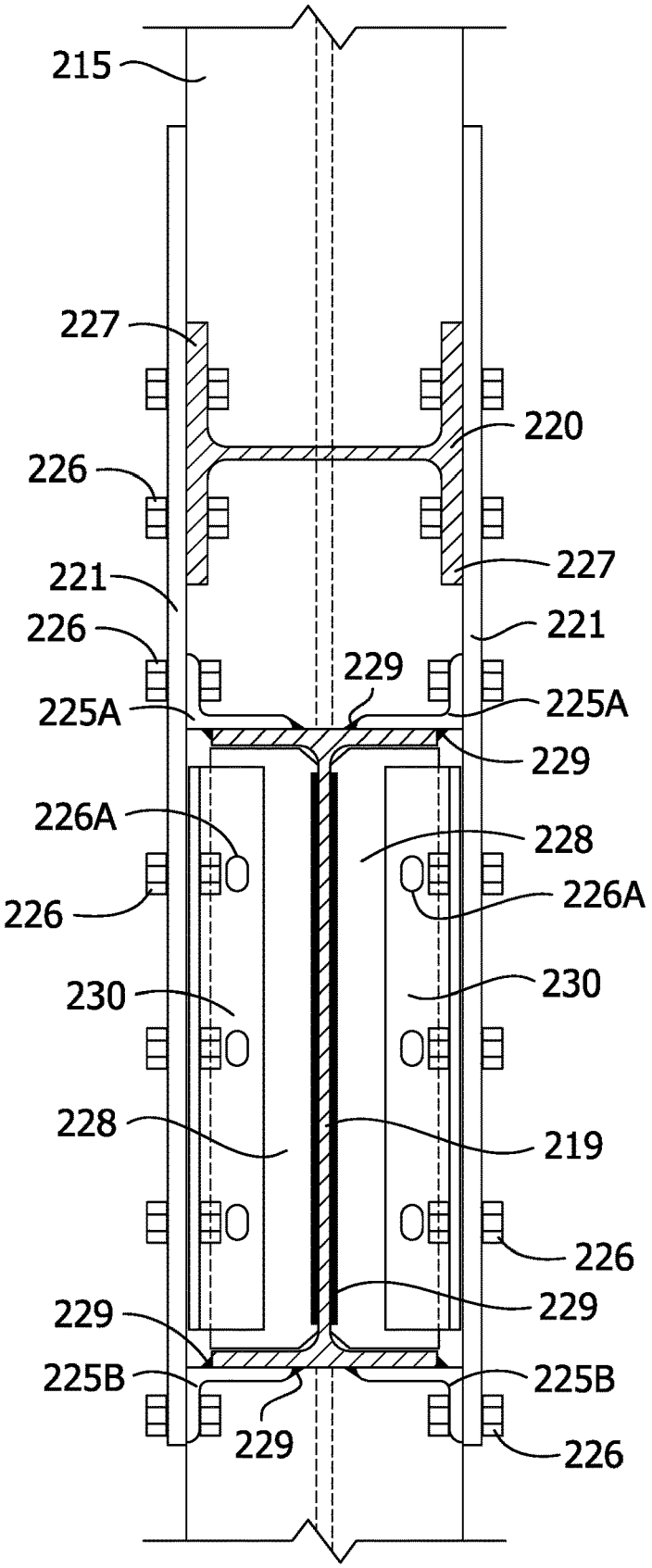
FIG. 11 is a section taken in the plane including line 11-11 of FIG. 10 with the bolts connecting the gusset plates to the beam assembly and the brace illustrated and bolts connecting angle irons to vertical shear plates removed to show openings through which they would extend.
Figure 12:
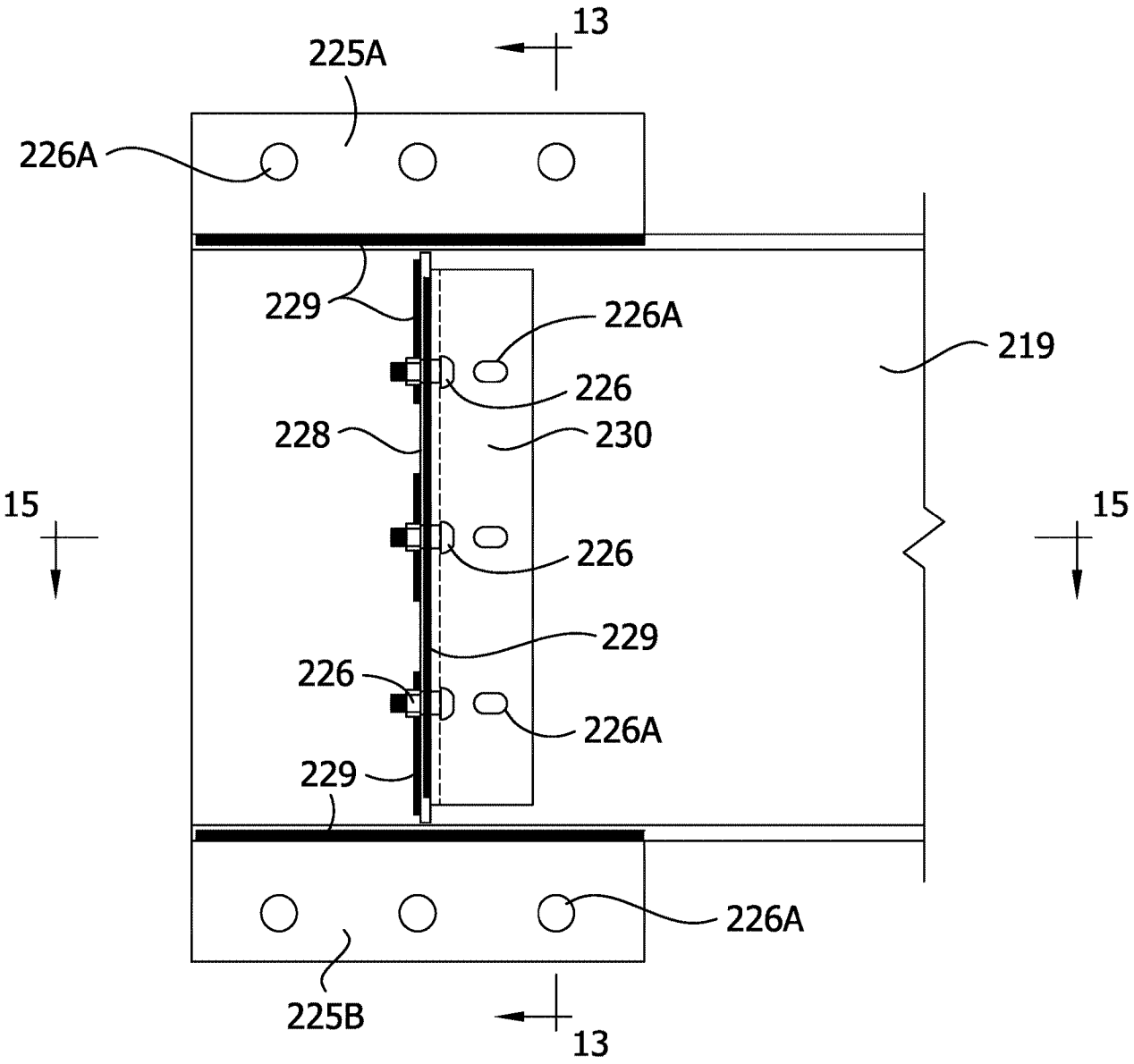
FIG. 12 is a fragmentary front view of a full-length beam assembly of the dual braced/moment resisting frame, beam-to-column-to-diagonal brace joint connection structure in FIG. 10.
Figure 13:
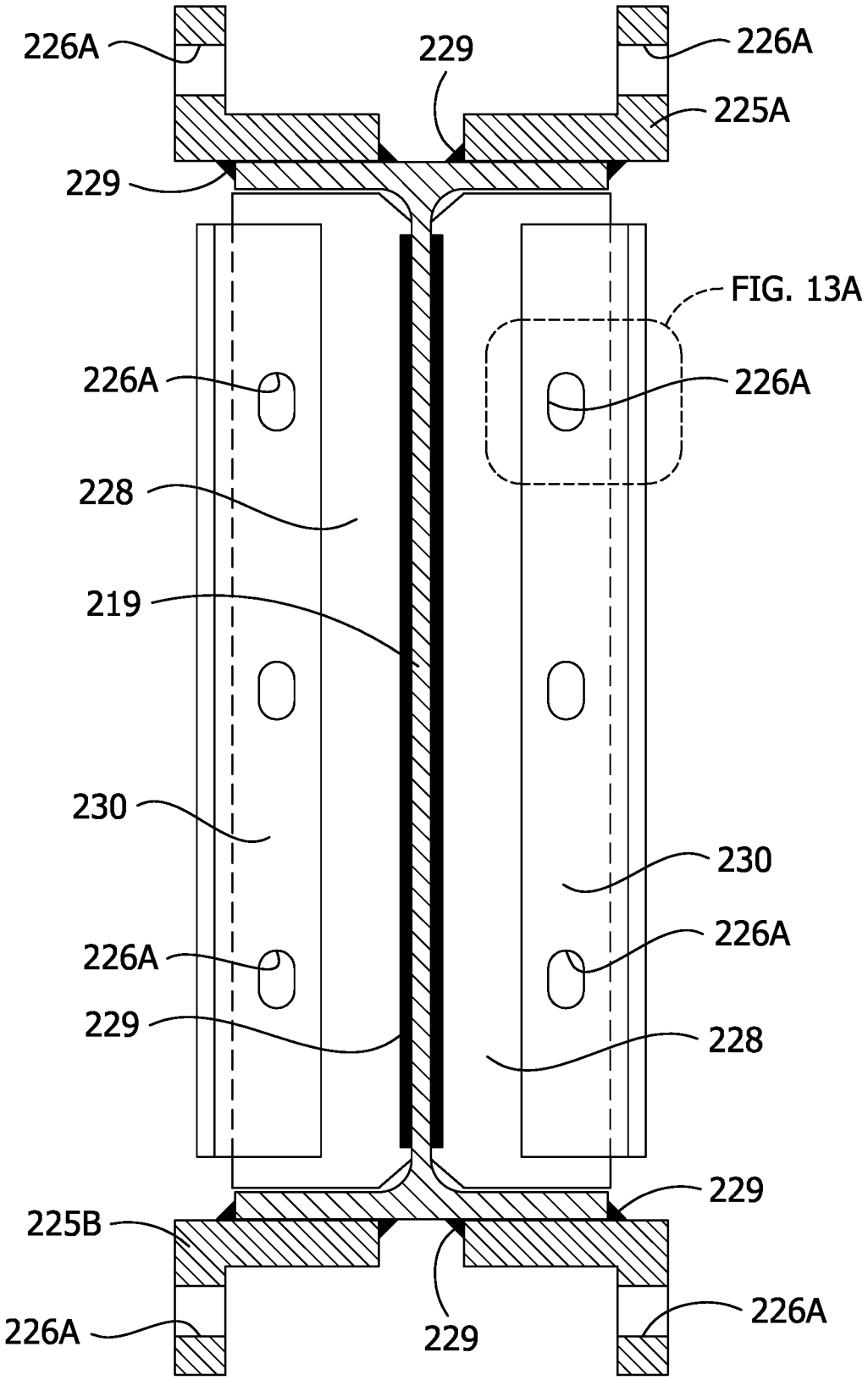
FIG. 13 is a section taken in the plane including line 13-13 of FIG. 12 but with bolts removed.
Figure 13A:
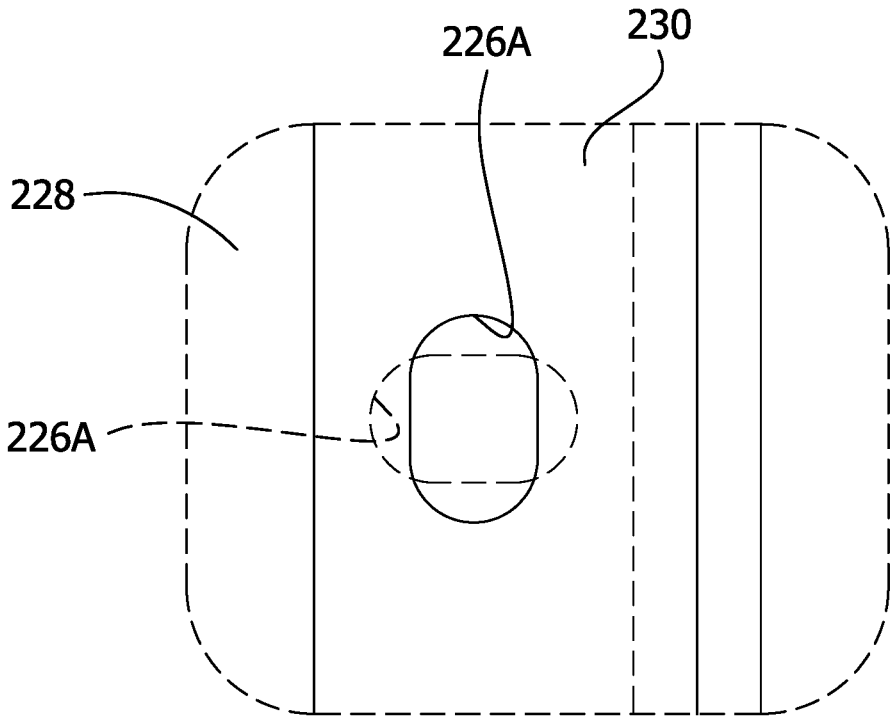
FIG. 13A is an enlarged fragmentary elevation of a portion of FIG. 13.
Figure 14:
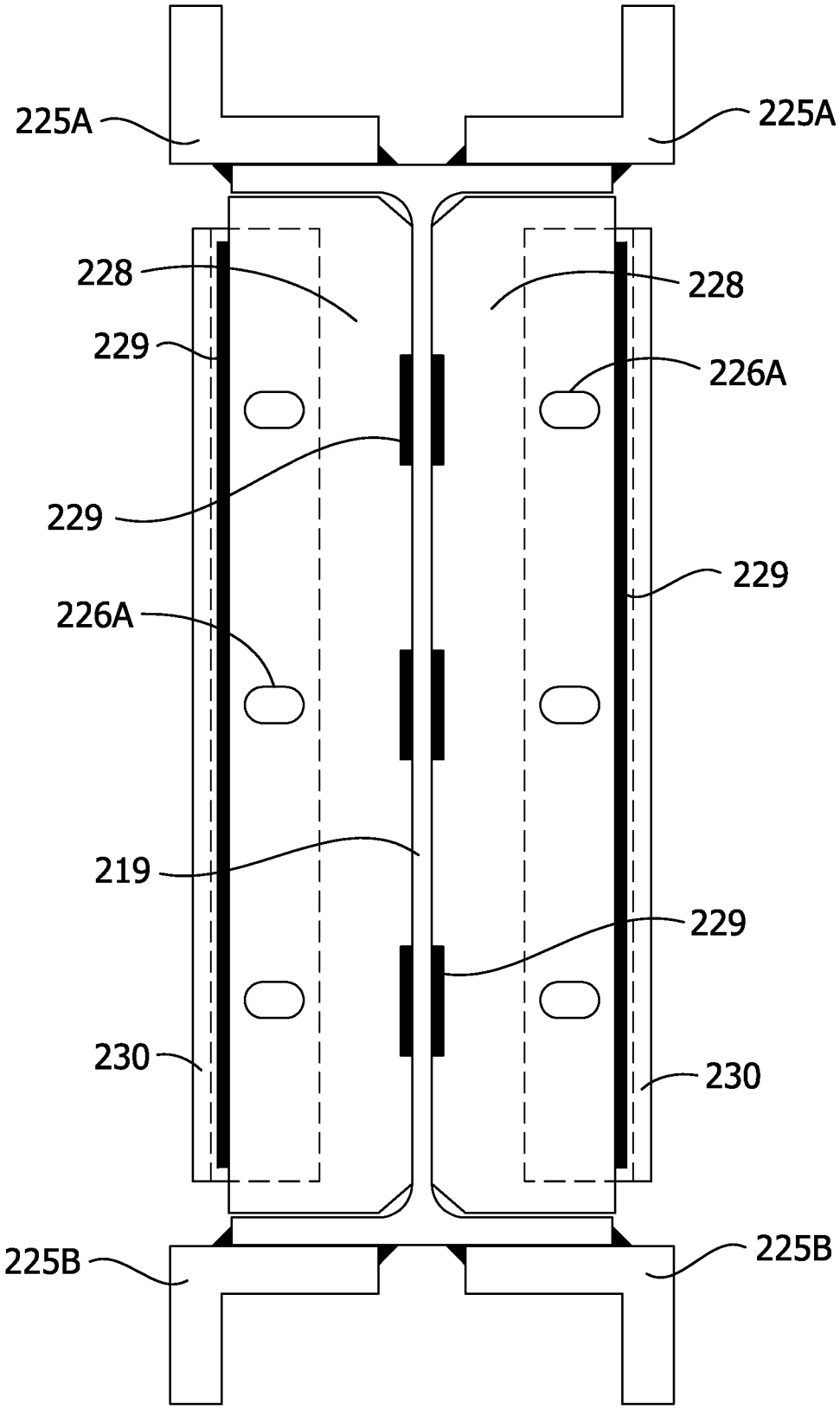
FIG. 14 is an end view of the full-length beam assembly of FIG. 12 but with bolts removed.
Figure 15:
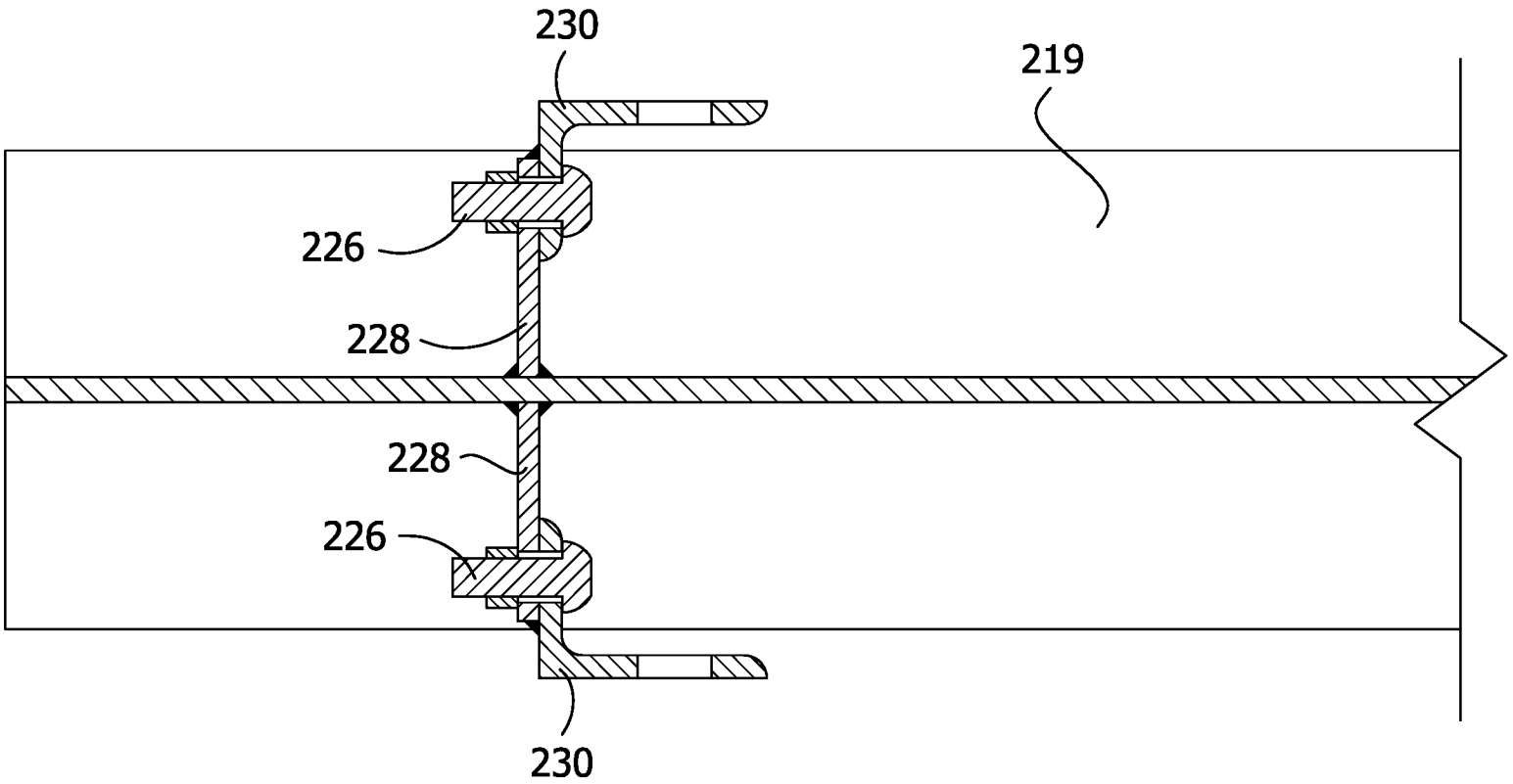
FIG. 15 is a section taken in the plane including line 15-15 of FIG. 12.

Referring to FIGS. 10-15, a dual braced/moment resisting frame, beam-to-column-to-diagonal brace joint connection structure of a third embodiment is generally indicated at 211. In the illustrated embodiment, the joint connection joins a column assembly 213 including a column 215 to a full-length beam assembly 217 including a full-length beam 219, and a brace 220 to the column assembly. The joint connection structure 211 of the third embodiment is substantially identical to the joint connection structure 11 of the first embodiment. The only difference between the two embodiments is that vertical angle iron 230 is bolted to vertical shear plate 228 (FIG. 11). The vertical angle irons 230 are L-shaped in vertical plan view. Each vertical angle iron 230 may include a vertically extending first leg bolted to a corresponding vertical shear plate 228 by vertically spaced bolts 226 extending through aligned bolt holes 226A in the first leg of the angle iron 230 and respective vertical shear plate 228 to connect the angle iron to the vertical shear plate. The bolt holes 226A in the first leg of the angle iron 230 may be slotted in a vertical direction and the bolt holes 226A in the vertical shear plate 228 may be slotted in a horizontal direction (FIG. 13A). The horizontal slotting of the bolt holes 226A in the vertical shear plate 228 and the vertical slotting of the holes 226A in the angle iron 230 allow the position of the angle iron 230 to be adjusted to a final position. Once the final position is achieved, a weld 229 secures the angle iron 230 in place relative to the vertical shear plate 228 and the beam 219 (FIG. 14). The bolts 226 extending through the slotted holes 226A in the vertical shear plate 228 and the angle iron 230 remain in place after the weld 229 for cooperating with the weld to fix the angle iron with respect to the vertical shear plate and beam 219. A second vertically extending leg projects perpendicular to the first leg along the length of the beam 219. An outer surface of the second leg of each angle iron 230 is bolted to an inner surface of a respective gusset plate 221 by vertically spaced bolts 226 extending through aligned bolt holes 226A in the second leg of the angle iron 30 and respective gusset plate to connect the web of the beam 219 to the gusset plate.

Figure 1A:
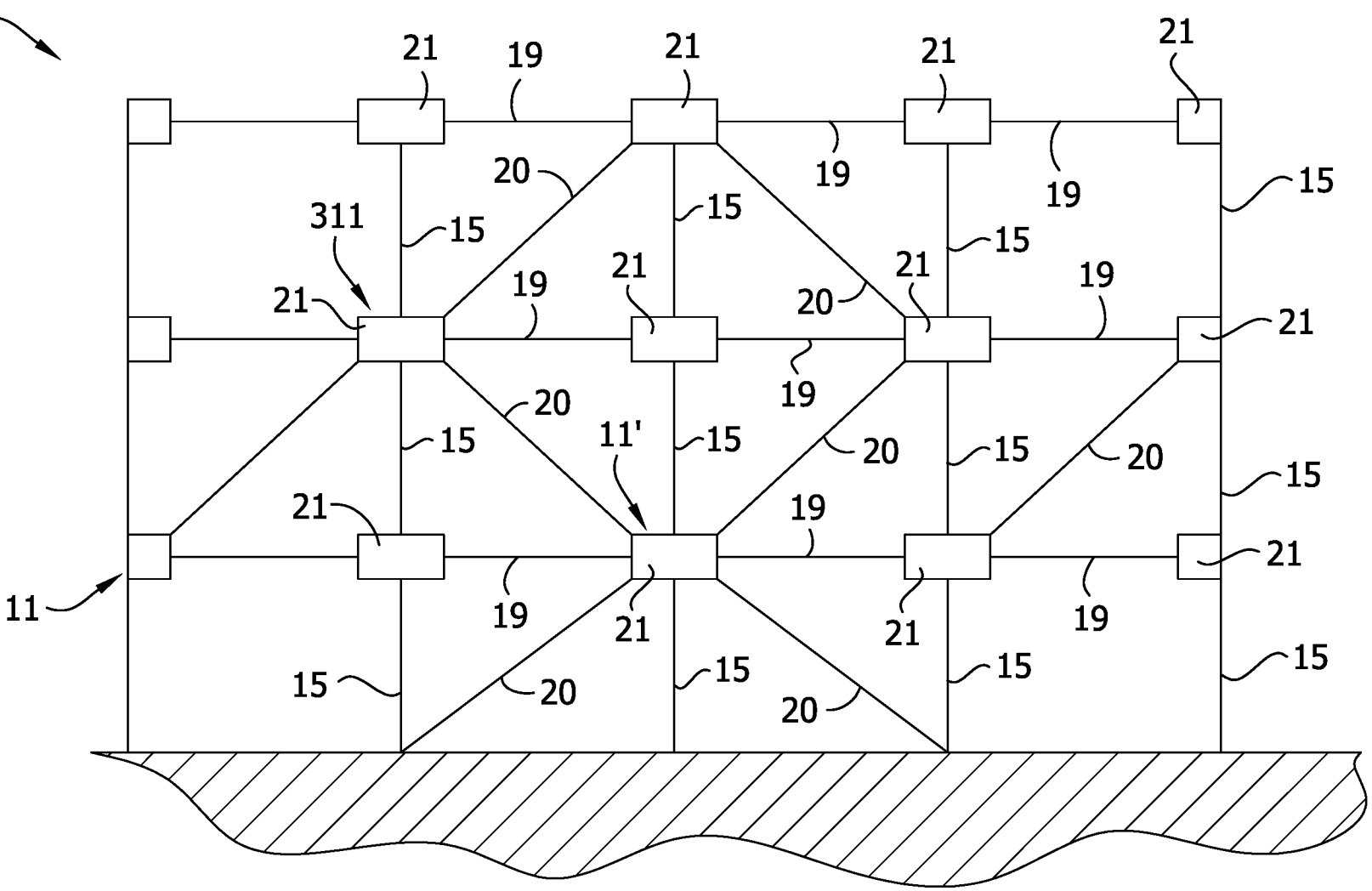
FIG. 1A is a diagrammatic elevation of a building framework.

Referring to FIGS. 1A and 16, a dual braced/moment resisting frame, beam-to-column-to-diagonal brace joint connection structure of a fourth embodiment is generally indicated at 311. In the illustrated embodiment, the joint connection joins a column assembly 313 including a column 315 to a full-length beam assembly 317 including a full-length beam 319, and upper and lower braces 320A, 320B to the column assembly. The joint connection structure 311 of the fourth embodiment is substantially identical to the joint connection structure 11 of the first embodiment. The only differences between the two embodiments is gusset plates 321 have upper and lower extensions 322 for receiving the upper and lower braces 320A, 320B. It is to be understood that the gusset plates can be configured to receive more than two braces between them. For example with reference to FIG. 1A, it may be seen that at one location (designated 11'), four braces are received between two gusset plates attached to one of the columns 15 and projecting to both sides of the column. Although not illustrated, in that situation the gusset plate may have four extensions, one for each of the four braces.

Figure 17:
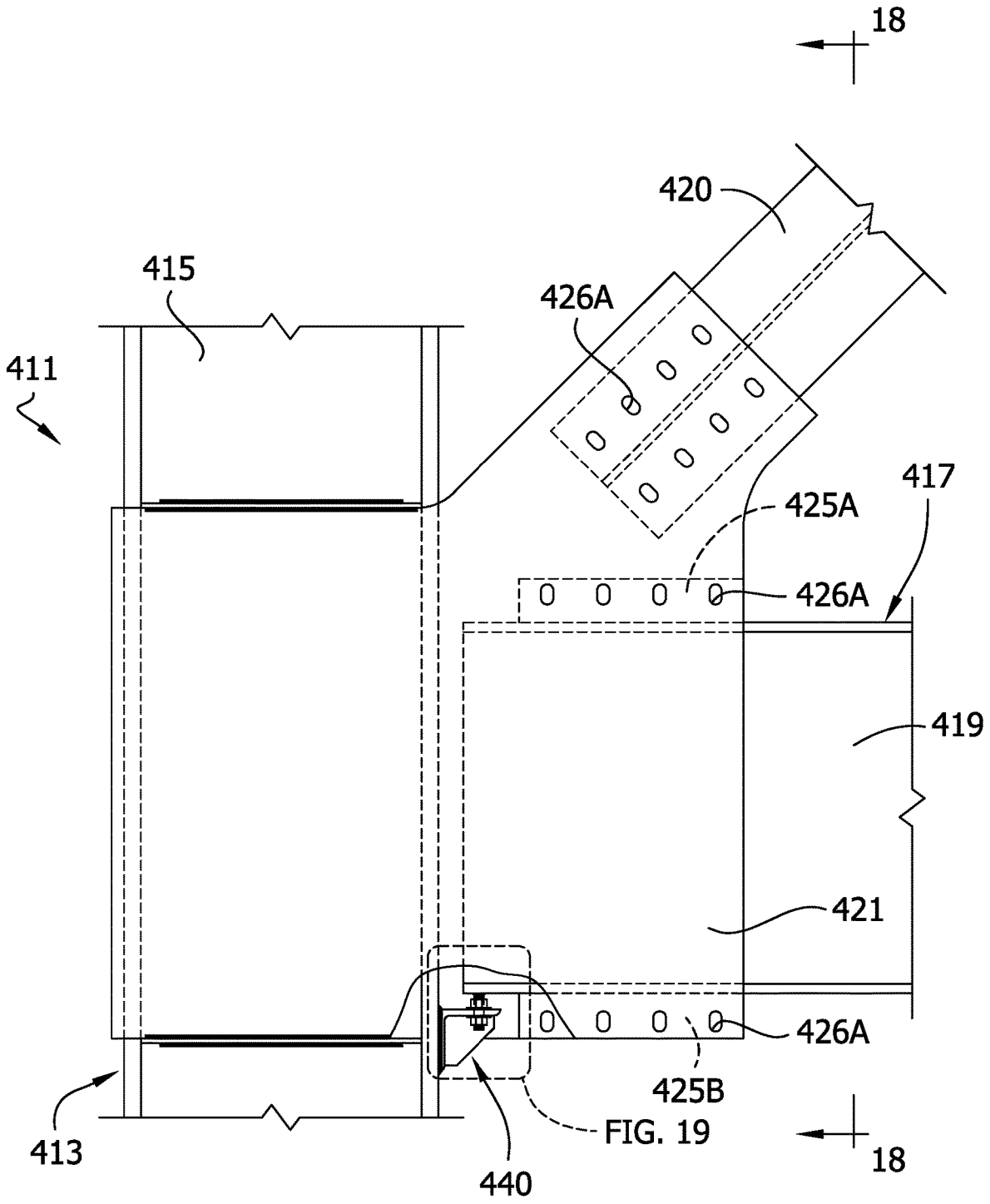
FIG. 17 is a front view of a dual braced/moment resisting frame, beam-to-column-to-diagonal brace joint connection structure of a fifth embodiment with bolts removed to show openings through which they would extend.
Figure 18:
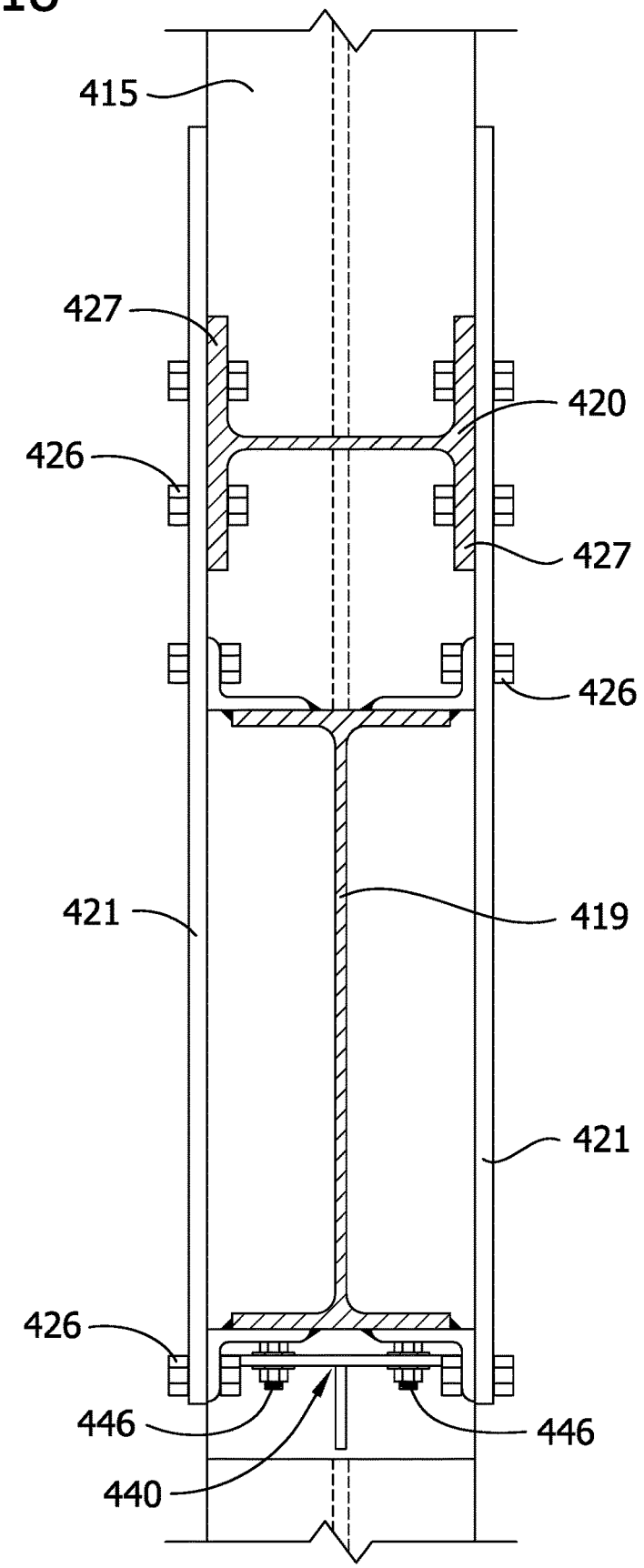
FIG. 18 is a section taken in the plane including line 18-18 of FIG. 17.
Figure 19:
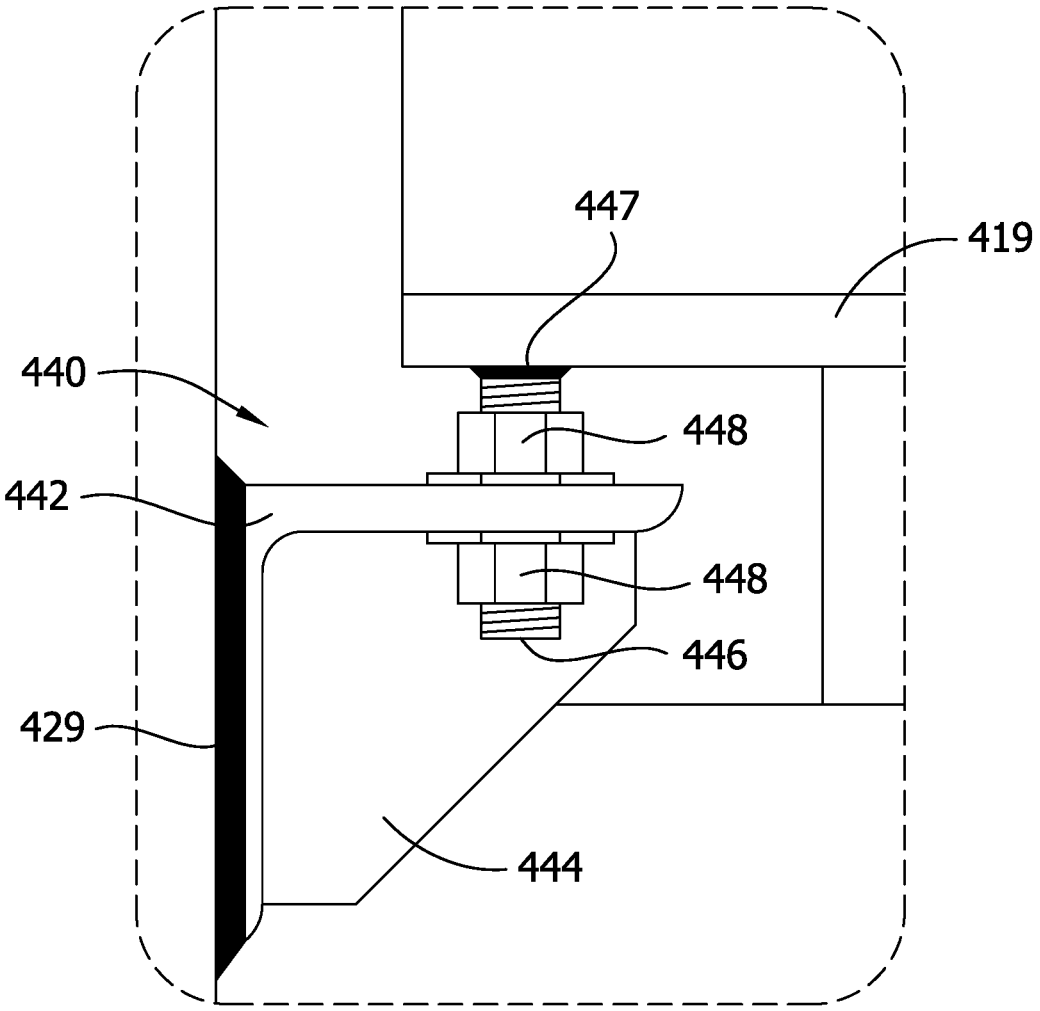
FIG. 19 is an enlarged fragmentary elevation of an adjustable beam seat in FIG. 17.

Referring to FIGS. 17-19, a dual braced/moment resisting frame, beam-to-column-to-diagonal brace joint connection structure of a fifth embodiment is generally indicated at 411. In the illustrated embodiment, the joint connection joins a column assembly 413 including a column 415 to a full-length beam assembly 417 including a full-length beam 419, and a brace 420 to the column assembly. The joint connection structure 411 of the fifth embodiment is similar to the joint connection structure 11 of the first embodiment. The difference between the two embodiments is that the vertical shear plate 28 and vertical angle iron 30, and associated bolt holes in the gusset plates, of the first embodiment are removed. Additionally, an adjustable beam seat 440 is attached to the column 415 in the fifth embodiment for temporarily supporting the full-length beam assembly 417 before being bolted to the column assembly 413. The adjustable beam seat 440 comprises an angle iron 442. The angle iron 442 may include a vertical first leg attached to a flange of the column 415 and a horizontal second leg projecting from the first leg away from the column perpendicular to a length of the column. The first leg is attached to the column 415 in a suitable manner such as by a weld 429 (FIG. 19). A reinforcement plate 444 is disposed generally at a middle of the angle iron 442 and defines a web connecting the first and second legs. The reinforcement plate 444 provides additional structural rigidity to the angle iron 442 so that the angle iron is able to support the weight of the full-length beam assembly 417. It will be understood that the reinforcement plate 444 may be omitted within the scope of the present invention.

A pair of threaded studs 446 extend through respective holes in the second leg of the angle iron 442. Each stud 446 is attached in the respective hole by a pair of nuts 448 threaded on the stud above and below the second leg of the angle iron 442. The top ends of the threaded studs 446 engage a bottom surface of a lower flange of the beam 419 to temporarily support the full-length beam assembly 417 before the full-length beam assembly is bolted to the column assembly 413. In the illustrated embodiment, the top end of each stud 446 is attached by weld 447 to the bottom surface of the lower flange of the beam 419. Typically, the threaded studs 446 are welded to the lower flange of the beam 419 in the shop during fabrication of the beam assembly. However, a stud or bolt (not shown) could be separate from the beam 419 (i.e., not welded to the beam) and selectively engageable with the beam.

The adjustable beam seat 440 is attached to the column 415, such that a top surface of a second leg of angle iron 442 is generally below a final design height of the lower flange of the beam 419 after the full-length beam assembly 417 is bolted to the column assembly. The nuts 448 can be selectively turned to move studs 446 and hence the full-length beam assembly 417 to the final beam height. In order to provide physical clearance between the angle iron 442 attached to column 413 and angle irons 425B, as well as to provide adequate worker access for adjusting the leveling nuts 448 of threaded studs 446 to raise or lower the full-length beam assembly 417 for fine tuning the alignment of bolt holes between gusset plates 421 and angle irons 425A, 425B during erection, the ends of angle irons 425B nearest the face of column 415 are located increased distances away from face of column 415 as compared to its location shown in FIG. 2. For reasons of design symmetry, angle irons 425A are located the same increased distance way from face of column 415.

In use, the full-length beam assembly 417 can be lowered down between the gusset plates 421 and engaged with the adjustable beam seat 440. The threaded studs 446 are received into respective holes in the angle iron 442 as the beam assembly 417 is lowered between the gusset plates until the upper nuts 448 engage the horizontal second legs of the beam seat 440. The lower nuts 448 are then threaded onto the lower ends of the threaded studs 446. To adjust the height of the full-length beam assembly 417 while being supported by the adjustable beam seat 440, the nuts 448 are rotated causing the beam assembly to either be raised when the nuts are rotated in a first direction or lowered when the nuts are rotated in a second direction opposite the first direction. Typically, this is done to achieve alignment of bolt holes in the gusset plates with bolt holes associated with the beam assembly 417 and/or brace 420. Once the full-length beam assembly 417 is in the selected position, the beam assembly can be bolted to the column assembly 413. Therefore, the adjustable beam seat 440 both supports the weight of the full-length beam assembly 417 and facilitates a fine tune adjustment of the height of the beam assembly for locating the beam assembly in a position for being bolted to the column assembly 413. The beam seat 440 allows the beam assembly 417 to be stabilized prior to any fixed connection to the column assembly 413.

Figure 20:
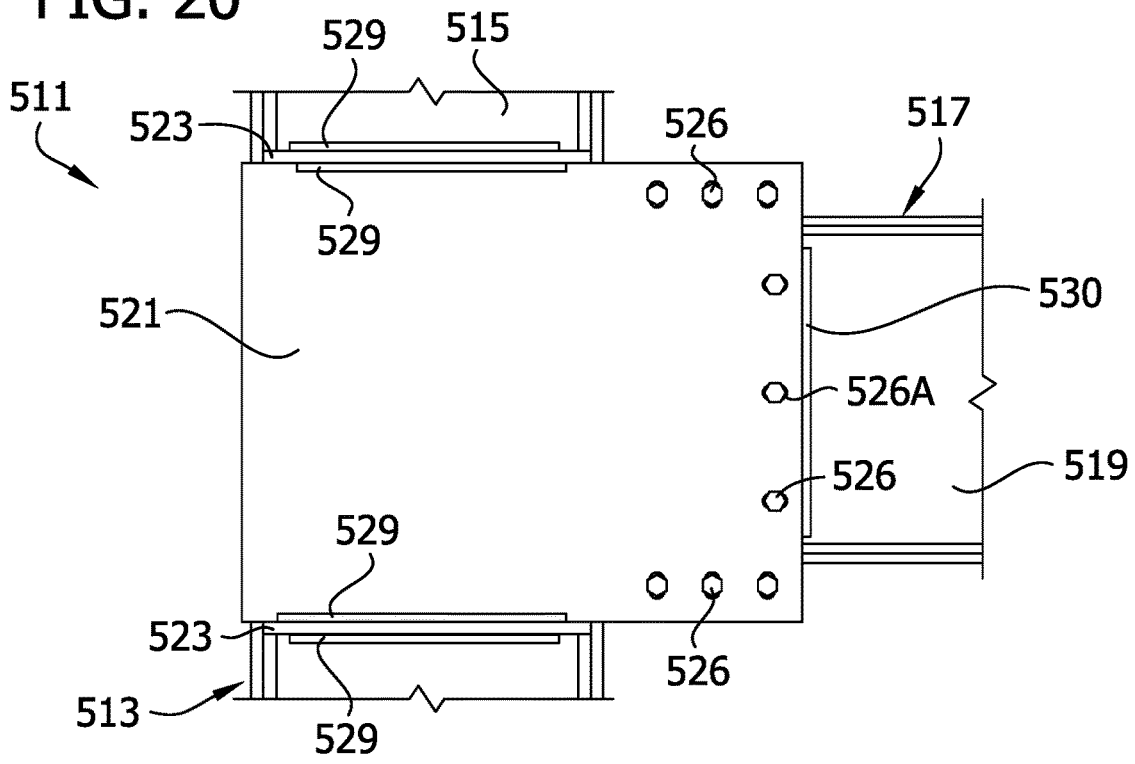
FIG. 20 is a front view of a beam-to-column joint connection structure of a sixth embodiment.
Figure 21:
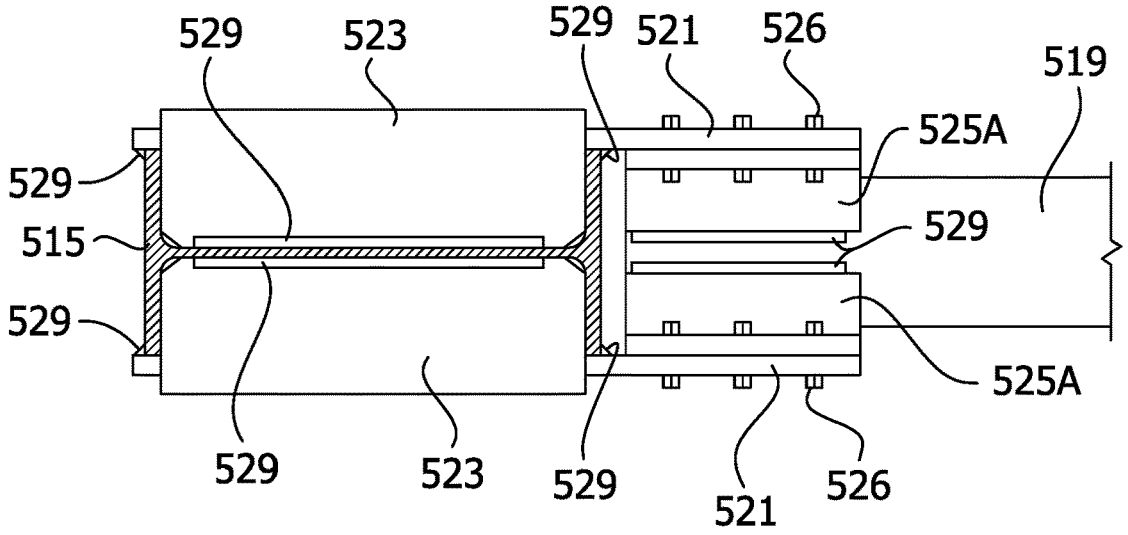
FIG. 21 is a top view of the beam-to-column joint connection structure of FIG. 20.
Figure 21A:
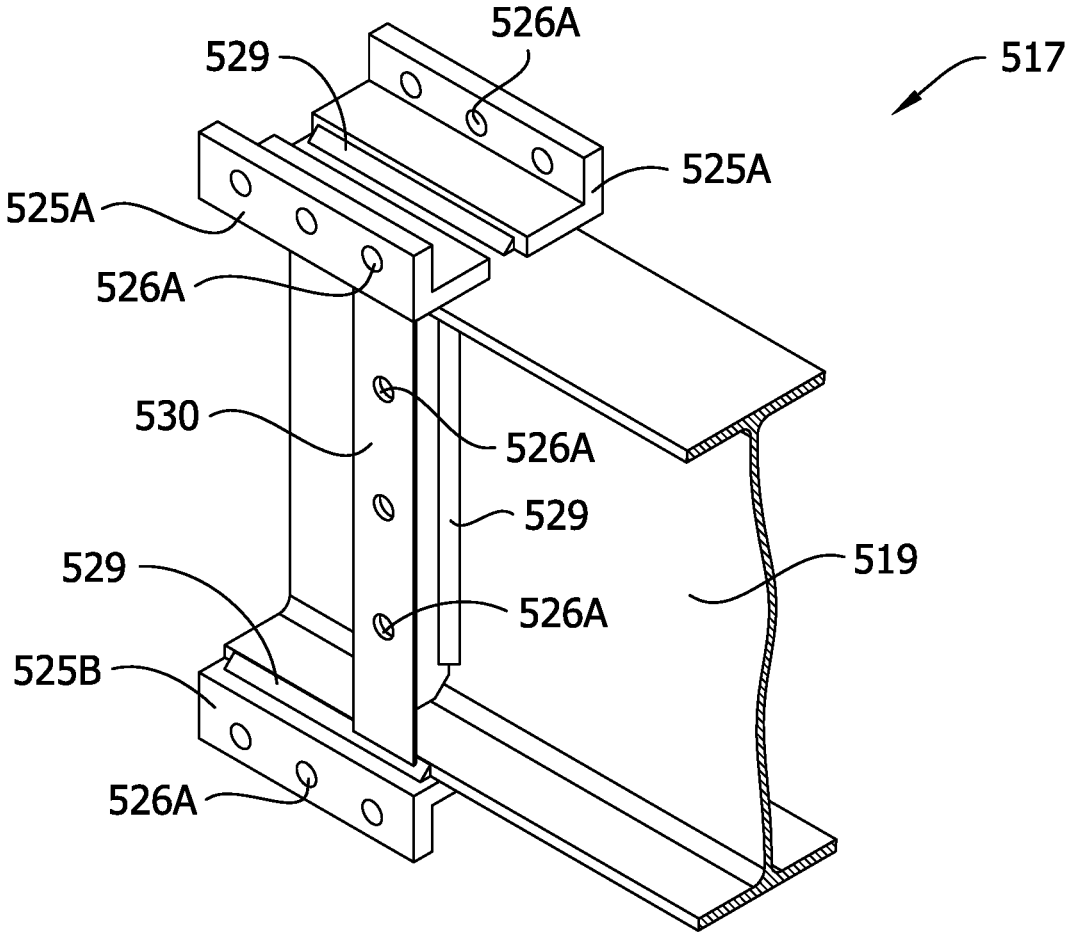
FIG. 21A is a fragmentary perspective of a full-length beam assembly of the beam-to-column joint connection structure of FIG. 20.

Referring to FIGS. 20-21A, a beam-to-column moment-resisting joint connection structure of a sixth embodiment is generally indicated at 511. In the illustrated embodiment, the joint connection joins a column assembly 513 including a column 515 to a full-length beam assembly 517 including a full-length beam 519. The joint connection structure 511 of the sixth embodiment is similar to the joint connection structure 11 of the first embodiment. The differences between the two embodiments is that the first embodiment is a dual braced/moment resisting frame, beam-to-column-to-diagonal brace joint connection structure which includes a brace 20 and modified gusset plates 21 for receiving an end portion of the brace. The joint connection structure 511 of the sixth embodiment is not a dual braced/moment resisting frame, beam-to-column-to-diagonal brace joint connection structure and thus omits the brace and incorporates rectangular gusset plates 521. However, as disclosed in the first embodiment, vertical shear plates 528 are welded at 529 to a web of the beam 519 and bolted to the gusset plates 521 by way of vertical angle irons 530 attached to the vertical shear plates.

Figure 22:
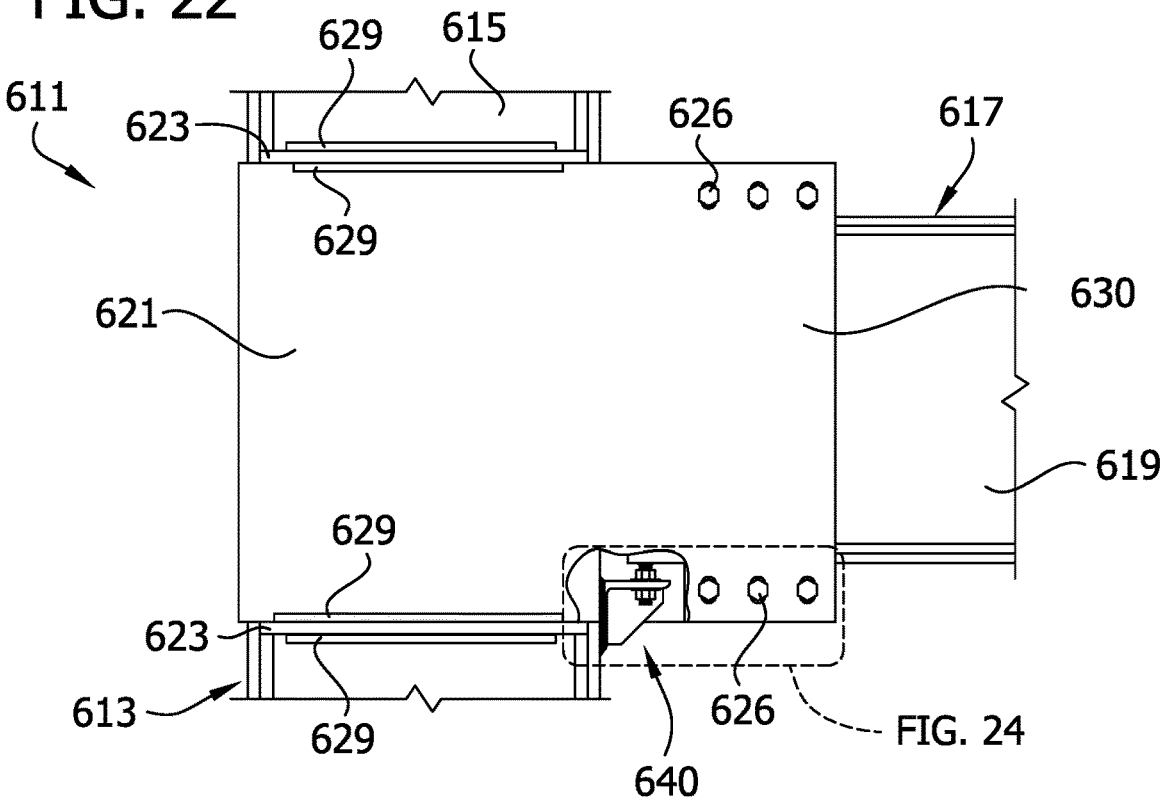
FIG. 22 is a front view of a beam-to-column joint connection structure of a seventh embodiment.
Figure 23:
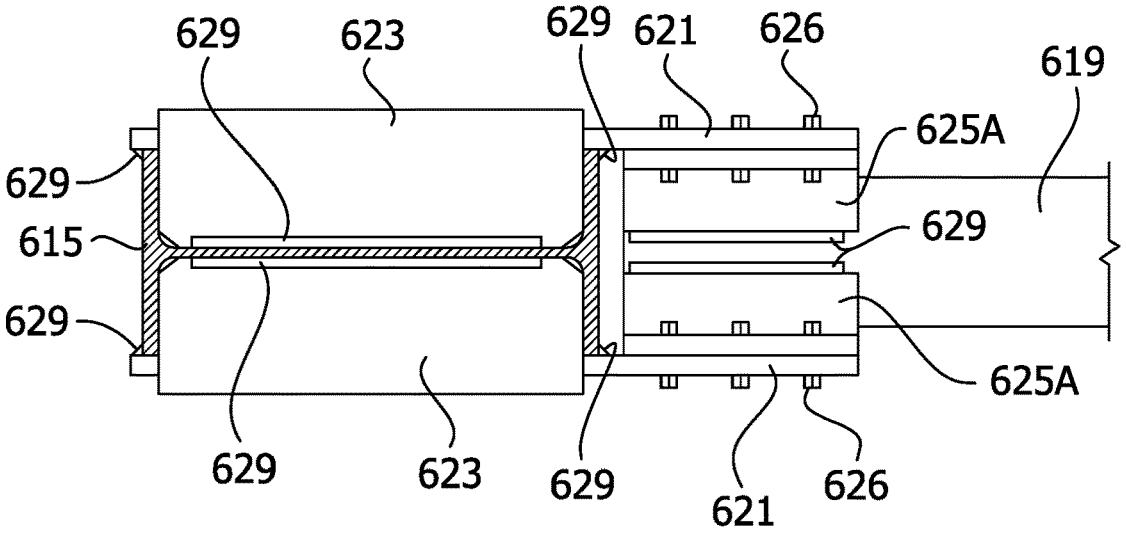
FIG. 23 is a top view of the beam-to-column joint connection structure of FIG. 22.
Figure 24:
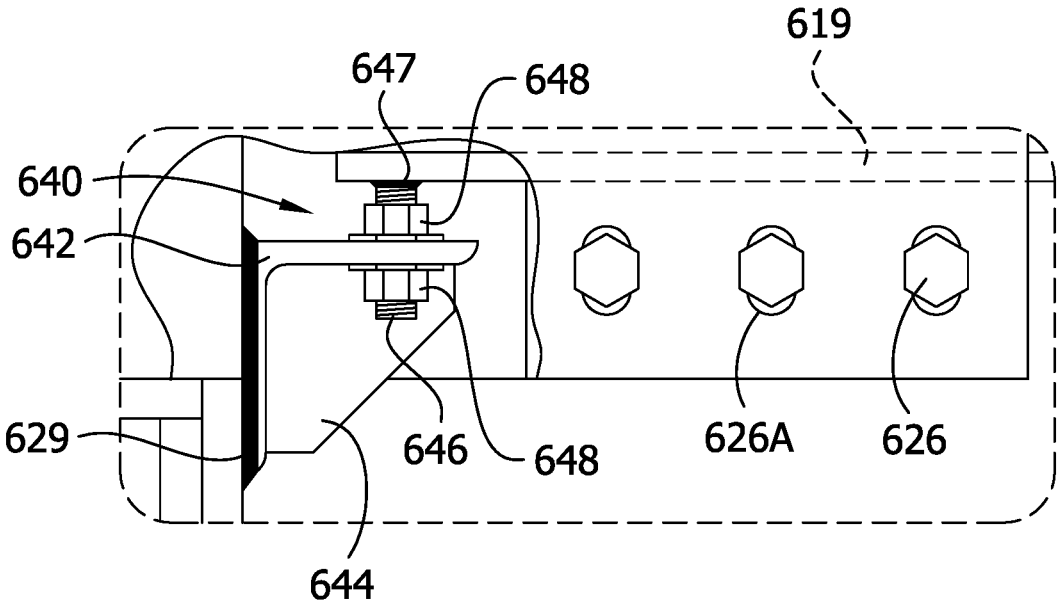
FIG. 24 is an enlarged fragmentary elevation of an adjustable beam seat in in FIG. 22.

Referring to FIGS. 22-24, a beam-to-column moment-resisting joint connection structure of a seventh embodiment is generally indicated at 611. In the illustrated embodiment, the joint connection joins a column assembly 613 including a column 615 to a full-length beam assembly 617 including a full-length beam 619. The joint connection structure 611 of the seventh embodiment is similar to the joint connection structure 411 of the fifth embodiment. The differences between the two embodiments is that the fifth embodiment is a dual braced/moment resisting frame, beam-to-column-to-diagonal brace joint connection structure and includes a brace 420 and modified gusset plates 421 for receiving an end portion of the brace. The joint connection structure 611 of the seventh embodiment is not a dual braced/moment resisting frame, beam-to-column-to-diagonal brace joint connection structure and thus omits the brace and incorporates rectangular gusset plates 621.

It will be understood that the specific connections described in each of the embodiments are interchangeable.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

Moment resisting column-to-beam joint connection structures, column assemblies and beam assemblies that are constructed according to the principles of the present invention provide numerous unique features, benefits and advantages. Reference is made to the figures illustrating one of the embodiments to which the advantages and benefits apply. All field-bolted dual braced/moment resisting frame, beam-to-column-to-diagonal brace joint connection structures, column assemblies, and full-length beam assemblies that are constructed according to the principles of the present invention provide numerous unique features and advantages. At least one embodiment has the advantage of reducing material quantities and associated cost. In at least one embodiment, the present invention provides ease and predictability of fabrication. At least one other embodiment may have the advantage of faster frame erection due to purposeful mitigation of erection alignment and milled, rolled section tolerance uncertainties. Still in other embodiments the present invention may provide maximum steel frame stiffness for controlling lateral drift of the structural frame system. In at least one embodiment, the present invention provides overall optimum performance when subjected to severe load application and system ductility demand on the joint connection structure.

What is claimed is:

1. A joint connection structure of a building framework comprising:

a column assembly including a column and a pair of gusset plates connected to the column on opposite sides of the column and extending laterally outward from the column, the column extending above and below the gusset plates and the gusset plates each including an extension projecting from the remainder of the gusset plate;

a full-length beam assembly including a full-length beam having upper and lower flanges and an end portion received between the gusset plates, the full-length beam being bolted to the gusset plates of the column assembly to connect the full-length beam assembly to the column assembly by bolts passing through the gusset plates to directly attach the gusset plates to the full-length beam assembly such that the full-length beam assembly is free of a weld directly contacting the gusset plates for connecting the full-length beam to the column assembly, the full-length beam assembly further comprising angle irons disposed on an upper surface of the upper flange; and a brace having an end portion received between the extensions of the gusset plates, the brace making an angle with the full-length beam and with the column, the brace being bolted to the extensions of the gusset plates at the end portion of the brace.

2. The joint connection structure of claim 1 wherein the full-length beam has a longitudinal axis and the extension projects at an angle to the longitudinal axis of the full-length beam.

3. The joint connection structure of claim 2 wherein the remainder of each gusset plate has a laterally outer edge spaced from the column and extending transverse to the longitudinal axis of the full-length beam, the extension projecting laterally outwardly from the laterally outer edge of the remainder of the gusset plate.

4. The joint connection structure of claim 3 wherein the gusset plates are each formed of a single piece of material.

5. The joint connection structure of claim 1 wherein the brace has a longitudinal axis and at least one of the extensions includes a row of bolt holes extending along the longitudinal axis of the brace and bolts in the bolt holes joining the brace to the extension.

6. The joint connection structure of claim 5 wherein said at least one extension includes a second row of bolt holes extending along the longitudinal axis of the brace and parallel to the row of bolt holes, and bolts in the second row of bolt holes joining the brace to the extension.

7. The joint connection structure of claim 6 wherein each bolt hole in the row of bolt holes is aligned with a corresponding one of the bolt holes in the second row of bolt holes.

8. The joint connection structure of claim 1 wherein the full-length beam comprises a web connecting the upper and lower flanges of the full-length beam, the joint connection structure further comprising a vertical shear plate attached to the web of the full-length beam, the vertical shear plate being bolted to one of the gusset plates, the vertical shear plate comprising a plate portion attached to the web of the full-length beam and an angle iron attached to the plate portion and bolted to one of the gusset plates.

9. The joint connection structure of claim 8 further comprising slotted bolt holes in one of said one of the gusset plates and the vertical shear plate for receiving bolts to connect the vertical shear plate to said one of the gusset plates, the slotted bolt holes being slotted such that a first dimension of the slotted bolt holes that extends generally parallel to a longitudinal axis of the full-length beam is greater than a second dimension of the slotted bolt holes that extends generally perpendicular to the longitudinal axis of the full-length beam.

10. The joint connection structure of claim 1 further comprising an adjustable beam seat attached to the column and supporting the full-length beam assembly at least partially between the gusset plates, the adjustable beam seat being configured to move the full-length beam assembly relative to the gusset plates prior to and separate from bolting the full-length beam assembly to the column assembly.

11. The joint connection structure of claim 1 wherein the full-length beam assembly comprises angle irons disposed on a lower surface of the lower flange, the angle irons on the upper and lower flanges being bolted to the gusset plates.

12. A joint connection structure of a building framework comprising:

a column assembly including a column and a pair of gusset plates connected to the column on opposite sides of the column and extending laterally outward from the column, the column extending above and below the gusset plates;

a full-length beam assembly including a full-length beam having upper and lower flanges and an end portion received between the gusset plates, the full-length beam assembly further comprising angle irons disposed on an upper surface of the upper flange;

beam bolts connecting the full-length beam to the gusset plates of the column assembly to connect the full-length beam assembly to the column assembly so that the end portion of the full-length beam is supported in spaced relation from the column, the beam bolts passing through the gusset plates to directly attach the gusset plates to the full-length beam assembly, the joint connection structure being free of a weld directly contacting the gusset plates for connecting the full-length beam to the column assembly;

a brace having an end portion received between the gusset plates, the brace making an angle with the full-length beam and with the column; and brace bolts connecting the end portion of the brace to at least one of the gusset plates so that the end portion of the brace is supported by said at least one of the gusset plates in a position between the gusset plates and spaced apart from the column.

13. The joint connection structure of claim 12 further comprising bolt holes in said at least one of the gusset plates and in the brace, the bolt holes being aligned and receiving corresponding ones of the brace bolt connecting the brace to the gusset plates.

14. The joint connection structure of claim 13 wherein the brace has a longitudinal axis and the brace bolts extend perpendicular to the longitudinal axis.

15. The joint connection structure of claim 14 wherein the brace bolts extend in a first row parallel to the longitudinal axis of the brace and in a second row parallel to the first row and to the longitudinal axis of the brace.

16. The joint connection structure of claim 15 wherein brace bolts in the first row are aligned with brace bolts in the second row across the longitudinal axis of the brace.

17. The joint connection structure of claim 12 wherein some of the brace bolts connect the brace to one of the gusset plates and some of the brace bolts connect the brace to another one of the gusset plates.

18. The joint connection structure of claim 12 wherein the full-length beam comprises a web connecting the upper and lower flanges of the full-length beam, the joint connection structure further comprising a vertical shear plate attached to the web of the full-length beam, the vertical shear plate being bolted to one of the gusset plates, the vertical shear plate comprising a plate portion attached to the web of the full-length beam and an angle iron attached to the plate portion and bolted to one of the gusset plates.

19. The joint connection structure of claim 12 further comprising an adjustable beam seat attached to the column and supporting the full-length beam assembly at least partially between the gusset plates, the adjustable beam seat being configured to move the full-length beam assembly relative to the gusset plates prior to and separate from bolting the full-length beam assembly to the column assembly with the beam bolts.

20. The joint connection structure of claim 12 wherein the full-length beam assembly comprises angle irons disposed on a lower surface of the lower flange, the angle irons on the upper and lower flanges being attached by the beam bolts to the gusset plates.

* * * * *